US007197273B2

(12) United States Patent
Imai et al.

(10) Patent No.: US 7,197,273 B2
(45) Date of Patent: Mar. 27, 2007

(54) SHEET FEEDING APPARATUS, IMAGE READING APPARATUS, AND IMAGE FORMING APPARATUS

(75) Inventors: Takashi Imai, Nara (JP); Shuhji Fujii, Kyoto (JP); Kaoru Ishikura, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 158 days.

(21) Appl. No.: 10/918,989

(22) Filed: Aug. 16, 2004

(65) Prior Publication Data

US 2005/0042005 A1 Feb. 24, 2005

(30) Foreign Application Priority Data

Aug. 18, 2003 (JP) ..... 2003-294592

(51) Int. Cl.
*G03G 15/00* (2006.01)

(52) U.S. Cl. ..... 399/371; 399/367

(58) Field of Classification Search ..... 271/265.01, 271/265.02, 153, 145, 265, 126, 127, 11; 400/624; 399/23, 369–371, 376, 377, 367
See application file for complete search history.

(56) References Cited

U.S. PATENT DOCUMENTS 4,763,891 A * 8/1988 Kodama ..... 271/157
5,100,122 A * 3/1992 Noda et al. ..... 271/155
5,314,179 A * 5/1994 Oda et al. ..... 271/145
5,347,350 A * 9/1994 Nakahata et al. ..... 399/23
5,915,690 A * 6/1999 Surya ..... 271/265.01
6,091,927 A 7/2000 Hattori et al.
6,152,631 A * 11/2000 Park ..... 400/708
6,361,038 B1 * 3/2002 Tada et al. ..... 271/111
6,659,449 B2 * 12/2003 Kim ..... 271/117
2002/0041786 A1 * 4/2002 Sato et al. ..... 400/624
2004/0028450 A1 * 2/2004 Jung ..... 400/709
2004/0061283 A1 * 4/2004 Hyun ..... 271/265.01
2004/0188916 A1 * 9/2004 Tsukamoto et al. ..... 271/110

FOREIGN PATENT DOCUMENTS

JP 05-094063 4/1993
JP 07-301962 11/1995
JP 11-199065 7/1999
JP 2001-002286 9/2001

* cited by examiner

*Primary Examiner*—Anthony H Nguyen
(74) *Attorney, Agent, or Firm*—Renner, Otto, Boisselle & Sklar, LLP

(57) ABSTRACT

In a sheet feeding apparatus, a contact-type sensor for detecting sheet-like documents stored in document tray is separated into upper document detector and a lower document detector arranged at upper and lower sides of the document tray, respectively. The sheet-like documents are detected separately with two actuators of the corresponding detectors. Accordingly, the requirement of a prior art for having a contact of the sensor increased in length in order to detect the sheets from a maximum to zero in the sheet storing unit can be eliminated.

17 Claims, 16 Drawing Sheets

L1 : 33mm
L2 : 24mm
H1 : 27mm
H2 : 22mm
H3 : 42mm
h1 : 10mm (CORRESPONDING TO 100 SHEETS)
h2 : 7mm (CORRESPONDING TO 70 SHEETS)
h3 : 20mm (CORRESPONDING TO 200 SHEETS)

SHEET FEEDING APPARATUS, IMAGE READING APPARATUS, AND IMAGE FORMING APPARATUS

CROSS-REFERENCE TO RELATED APPLICATIONS

This non-provisional application claims priority under 35 U.S.C. §119(a) on Patent Application No. 2003-294592 filed in Japan on Aug. 18, 2003, the entire contents of which are hereby incorporated by reference.

BACKGROUND OF THE INVENTION

1. Field of the Invention

The present invention relates to a sheet feeding apparatus for reading image of sheet-like document by feeding from a document tray (a sheet storing unit) a series of sheets, each on which image of document is formed, to read the image of document formed on the sheet, and also relates to an image reading apparatus and an image forming apparatus, each equipped with the sheet feeding apparatus.

2. Description of Related Art

It is commonly known that an up-to-date image forming apparatus or the like is equipped with a document reading apparatus where a series of sheets each having image of document formed thereon are set by being stacked and stored in a document tray are automatically transferred sheet by sheet from the document tray to an image reading apparatus for sequentially reading the image of document formed on the sheet. The image forming apparatus equipped with such a document reading apparatus is designed to read a document and form an image at high efficiency. It is also demanded to read an image from a document, convert the read result into an electronic data, and form an image of the document from the electronic data obtained as described above at higher speeds (See Japanese Patent Application Laid-Open No. H05-94063A (1993) and Japanese Patent Application Laid-Open No. H07-301962A (1995), etc).

So far for high-speed processing of the sheet-like documents, the number of sheet-like documents stored in the document tray in a conventional document reading apparatus is substantially 100 to 200. Also, as the document reading apparatus has been improved and advanced at its sheet feeding unit, the types of documents to be conveyed are increased.

It is essential in the document reading apparatus permitting a series of sheets on which image of documents are formed to be set (stored) in the document tray and fed out in a sequence for reading the image of the document with an image reading apparatus to take out (pick up) the uppermost one of the sheets stacked in the document tray before feeding to the image reading apparatus. For the purpose, the document tray is used of a lift type tray (elevation/lowering tray) having a sheet elevation/lowering function (in upward and downward directions) (See Japanese Patent Application Laid-Open No. H11-199065A (1999)). Such an elevation/lowering tray has a sheet detector (a document detector) for detecting whether or not the sheets are correctly set in the elevation/lowering tray particularly throughout the elevation/lowering range of the elevation/lowering tray. When so, it is also detected whether the sheets are placed at their correct position at the deepest end of the elevation/lowering tray.

Such sheet detectors are employed as contact type sensors at the upper side or the lower side in either a common fixed type tray or an elevation/lowering tray of the document tray.

The sheet detector has a bar-like contact thereof provided to come into contact with the leading end of the sheets so as to detect whether the sheets are correctly set or not.

However, when the number of sheets set in the document tray becomes larger, the contact of the sensor has to be increased in the overall length as shown in FIG. 1 and FIG. 2. More particularly, when a sensor S1' is provided at the upper side of a document tray 22, the contact S1*a*' of the sensor S1' has to be increased in the area of the movement, that is, it is simply required to increase the length of the contact S1*a*'. This may cause interruption between the contact S1*a*' and a guide-in roller R1, between the contact S1*a*' and a pair of separate rollers R2 and R2*a*, and between the contact S1*a*' and the axis of each roller. Also, as shown in FIG. 2, when a sensor S1 is provided at the lower side of the document tray 22, the movement area of its contact S1*a* may relatively be small. However, when there is a curled sheet SR and the number of the sheets in the stack SB is decreased, the detection of the sheets in the state where document tray 22 elevates may be difficult thus resulting in fault detection. Moreover, when the sensor located at the upper side of the document tray, not shown, and the number of sheets becomes smaller, a curled sheet may hardly be detected.

On the other hand, an optical sensor is used for projecting light onto the sheets from the upper side to the lower side or from the lower side to the upper side to detect the sheets in the document tray. However, such an optical sensor used as the sheet detector requires a troublesome adjustment for detecting the sheets from one type to another. In addition, its detecting operation is hardly applicable to not only transparent OHP sheets but also semi-transparent sheets or transparent portion contained sheets.

BRIEF SUMMARY OF THE INVENTION

The present invention has devised in view of the foregoing drawbacks and its object is to provide a sheet feeding apparatus in which the contact of a contact-type sheet detector is separated into two parts provided at both upper and lower sides of a document tray, respectively whereby the foregoing drawbacks can be eliminated and a variety of control operations which are not conducted by any conventional detector can be carried out. It is also another object of the present invention to provide an image reading apparatus equipped with such sheet feeding apparatus and an image forming apparatus equipped with such image reading apparatus.

A sheet feeding apparatus as a first aspect of the present invention is a sheet feeding apparatus comprising: a sheet storing unit in which a number of sheets are stored in a stack; a sheet feeding mechanism for picking up and feeding out the sheets stored in the sheet storing unit in a sequence from the uppermost one; and a sheet detector having a contact for contacting the sheets stored in the sheet storing unit to detect the presence or absence of the sheets, characterized in that the contact consists of a first contact extending downwardly from a higher position than the sheet storing unit and a second contact extending upwardly from a lower position than the sheet storing unit.

According to the sheet feeding apparatus as the first aspect of the present invention, the separated contact into two parts provided at both upper and lower sides of the sheet storing unit detect whether sheets are present or not in the sheet storing unit and their detection results to be used for determining a variety of judgments and carrying out various control based on the judgment results.

A sheet feeding apparatus as a second aspect of the present invention is a sheet feeding apparatus according to the first aspect, characterized in that the sheet detector includes a first sheet detector arranged at a position higher than the sheet storing unit and a second sheet detector arranged at a position lower than the sheet storing unit, and the first contact is provided in the first sheet detector while the second contact is provided in the second sheet detector.

According to the sheet feeding apparatus as the second aspect of the present invention, the contacts of the two sheet detectors provided at both upper and lower sides of the sheet storing unit detect whether sheets are present or not in the sheet storing unit, respectively and the combination of their detection results is used for determining a variety of judgments and carrying out various control based on the judgment results.

A sheet feeding apparatus as a third aspect of the present invention is a sheet feeding apparatus according to the second aspect, characterized in that the first and second contacts are configured so that a first detecting area of the first contact for detecting the sheets stored in the sheet storing unit, and a second detecting area of the second contact for detecting the sheets stored in the sheet storing unit partially overlap each other.

According to the sheet feeding apparatus as the third aspect of the present invention, the two areas detected by respective contacts partially overlap each other, whereby the sheets stored in the sheet storing unit can be detected by at least one of the contacts.

A sheet feeding apparatus as a fourth aspect of the present invention is a sheet feeding apparatus according to the third aspect, characterized by further comprising: a height detector for detecting the height of the uppermost one of the sheets stored in the sheet storing unit; an elevation/lowering mechanism for elevating or lowering the sheet storing unit at a predetermined speed within a predetermined range; and a control circuit for controlling the elevation/lowering mechanism in response to a detection result of the height detector so as to keep the height of the sheet storing unit where the height of the uppermost one of the sheets stored in the sheet storing unit is equal to a height for picking up the sheets within the first and second detecting areas.

According to the sheet feeding apparatus as the fourth aspect of the present invention, when the sheet storing unit stores a large number of the sheets, a height of the uppermost sheet of the sheets stored in the sheet storing unit is kept at a predetermined height where a sheet is picked up by the sheet feeding mechanism.

A sheet feeding apparatus as a fifth aspect of the present invention is a sheet feeding apparatus according to the fourth aspect, characterized by further comprising: a sheet volume calculating circuit for determining a volume of the sheets stored in the sheet storing unit based on a detection result of the first contact and a detection result of the second contact.

According to the sheet feeding apparatus as the fifth aspect of the present invention, the volume of the sheets stored in the sheet storing unit is roughly determined by combining the detection results of the two contacts.

A sheet feeding apparatus as a sixth aspect of the present invention is a sheet feeding apparatus according to the fifth aspect, characterized by further comprising: a sheet storing unit position detector for detecting whether or not the sheet storing unit is at its lower-limit position within the predetermined range; and a control circuit for controlling the elevation/lowering mechanism to elevate the sheet storing unit at a speed higher than the predetermined speed when the sheet storing unit position detector detects that the sheet storing unit is at the lower-limit position and the sheet volume calculating circuit determines that the volume of the sheets stored in the sheet storing unit is the volume which is not detected within the first detecting area.

According to the sheet feeding apparatus as the sixth aspect of the present invention, the sheet storing unit is elevated at a speed higher than the normal speed from its lower-limit position when it is determined that a small number of sheets are stored in the sheet storing unit positioned at the lower-limit position where a maximum of the sheets can be stored.

An image reading apparatus according to the present invention is characterized by the sheet feeding apparatus according to any of the above described aspects.

An image forming apparatus according to the present invention is characterized by the sheet feeding apparatus according to any of the above described aspects.

Further, the image forming apparatus according to the present invention is characterized by the image reading apparatus equipped with the sheet feeding apparatus according to any of the above described aspects.

Also, an image forming apparatus according to the present invention is an image forming apparatus characterized by comprising: an image reading apparatus in which a sheet feeding apparatus is incorporated, the sheet feeding apparatus comprising: a sheet storing unit in which a number of sheets are stored in a stack; a sheet feeding mechanism for picking up and feeding out the sheets stored in the sheet storing unit in a sequence from the uppermost one; and a sheet detector having a contact for contacting the sheets stored in the sheet storing unit to detect the presence or absence of the sheets; wherein the contact consists of a first contact extending downwardly from a higher position than the sheet storing unit and a second contact extending upwardly from a lower position than the sheet storing unit; the sheet detector includes a first sheet detector arranged at a position higher than the sheet storing unit and a second sheet detector arranged at a position lower than the sheet storing unit, and the first contact is provided in the first sheet detector while the second contact is provided in the second sheet detector; and the first and second contacts are configured so that a first detecting area of the first contact for detecting the sheets stored in the sheet storing unit and a second detecting area of the second contact for detecting the sheets stored in the sheet storing unit partially overlap each other; a height detector for detecting the height of the uppermost one of the sheets stored in the sheet storing unit; an elevation/lowering mechanism for elevating or lowering the sheet storing unit at a predetermined speed within a predetermined range; a control circuit for controlling the elevation/lowering mechanism in response to a detection result of the height detector so as to keep the height of the sheet storing unit where the height of the uppermost one of the sheets stored in the sheet storing unit is equal to a height for picking up the sheets within the first and second detecting areas; a sheet volume calculating circuit for determining a volume of the sheets stored in the sheet storing unit based on a detection result of the first contact and a detection result of the second contact; a memory unit for storing the data of images read by the image reading apparatus and inputted from the external; an image forming unit for forming images based on the data stored in the memory unit; and a control circuit for setting an allocated capacity of the memory unit for storing the data of images read by the image reading apparatus in response to the volume of the sheets stored in the sheet storing unit calculated by the sheet volume calculating circuit, and for permitting the input of images from the external when the allocated capacity of the memory unit for storing the data of images read by the image reading apparatus is not larger than a predetermined value.

According to such image forming apparatus, the memory unit stores at a small storage area for storing the data of images when the number of the sheets stored in the sheet storing unit is small while the remaining storage area can be allocated for other processing.

The above and further objects and features of the present invention will more fully be apparent from the following detailed description with accompanying drawings.

BRIEF DESCRIPTION OF THE DRAWINGS

FIG. 3 is a longitudinally cross sectional view illustrating an example of the overall schematic configuration of an image reading apparatus equipped with an ADF (automatic document feeder) in which a sheet feeding apparatus according to the present invention is built in;

FIG. 12 is a flowchart showing a procedure of operation of a digital multiple function printer in which a sheet feeding apparatus of the present invention is built in;

FIG. 13 is a flowchart showing a procedure of operation of a digital multiple function printer in which a sheet feeding apparatus of the present invention is built in;

FIG. 14 is a flowchart showing a procedure of operation of a digital multiple function printer in which a sheet feeding apparatus of the present invention is built in;

FIG. 15 is a flowchart showing a procedure of operation of a digital multiple function printer in which a sheet feeding apparatus of the present invention is built in.

DETAILED DESCRIPTION OF THE PREFERRED EMBODIMENTS

Figure 1:
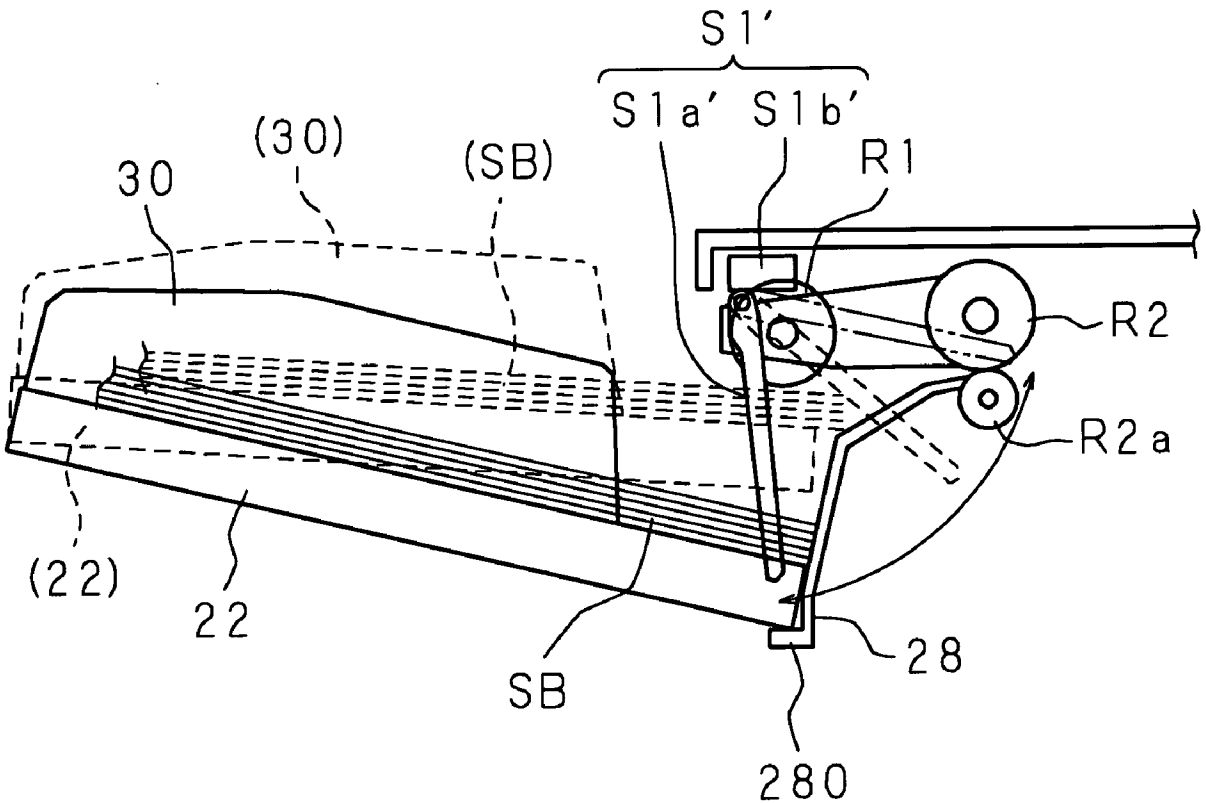
FIG. 1 PRIOR ART
FIG. 1 is an explanatory view of a prior art.
Figure 2:
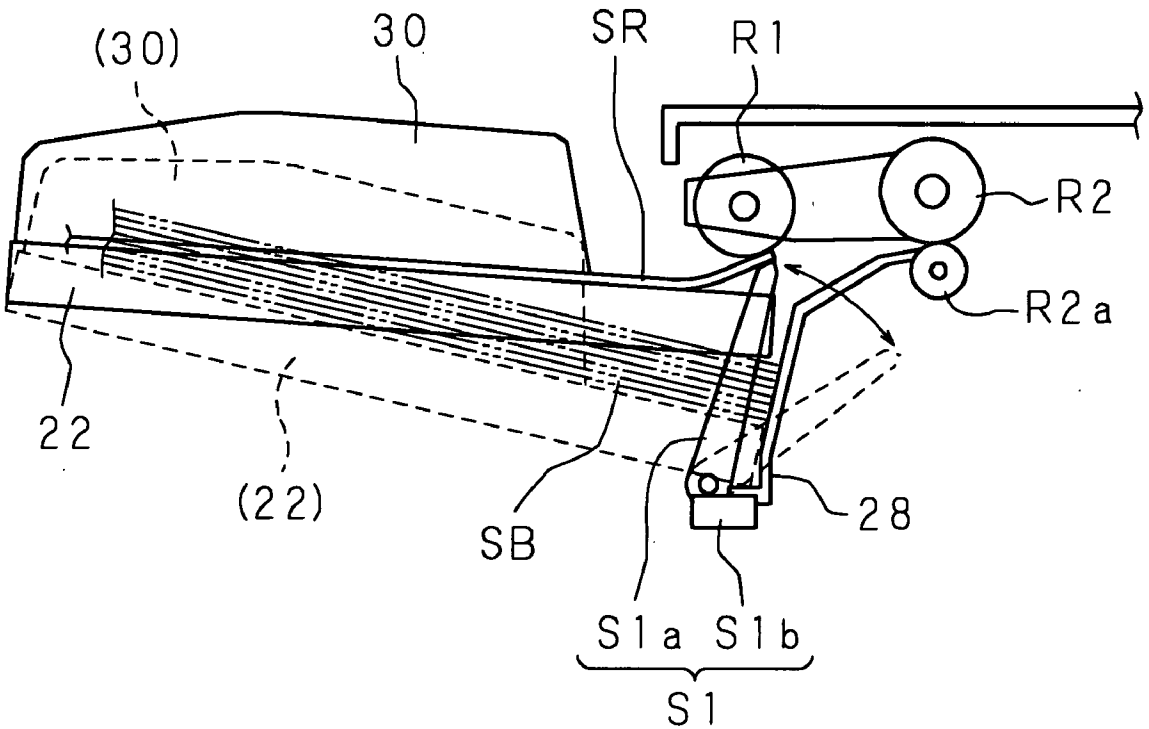
FIG. 2 PRIOR ART
FIG. 2 is an explanatory view of another prior art.
Figure 3:
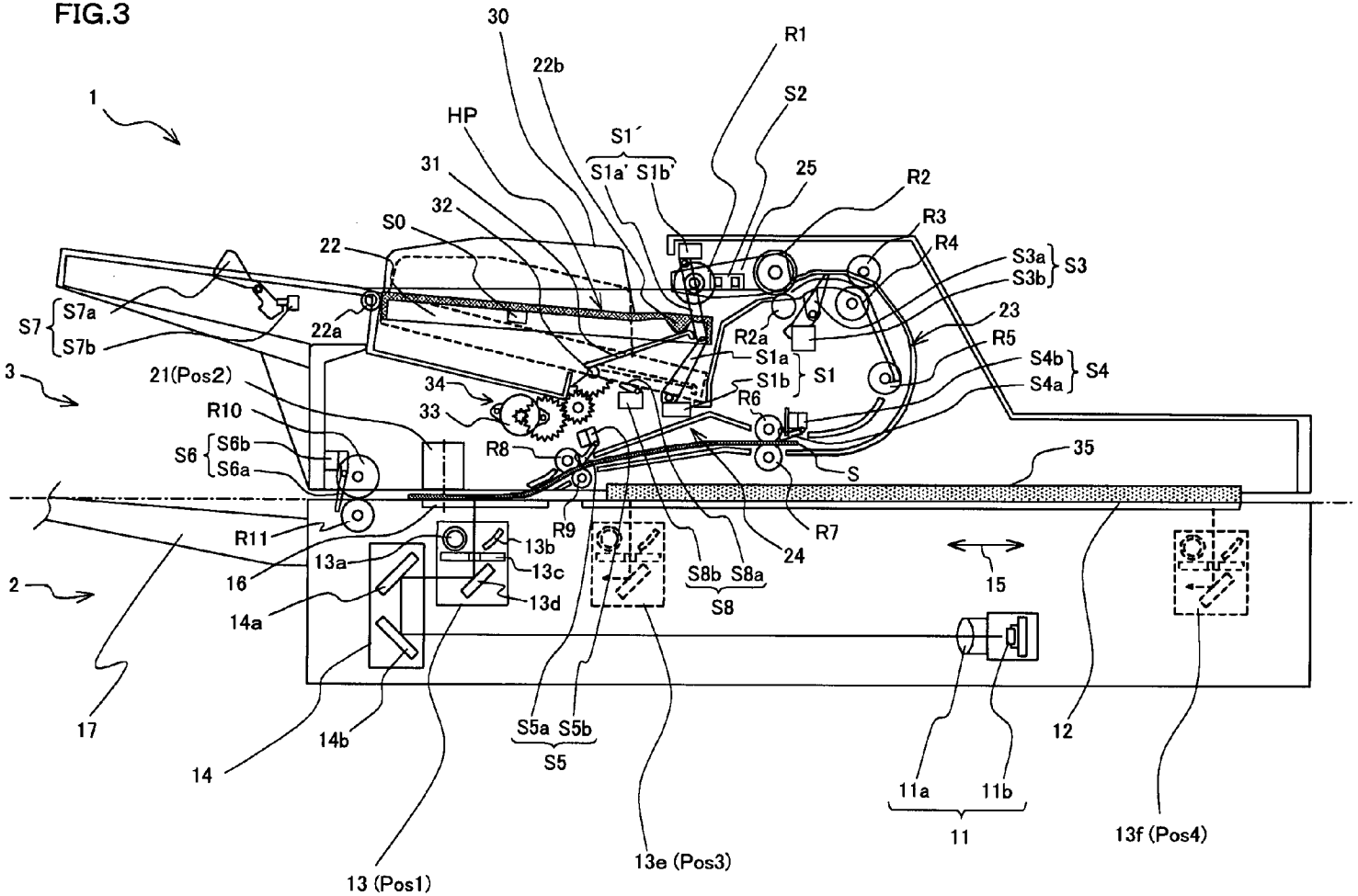

The best modes for embodying the present invention will be described in more detail referring to the accompanying drawings. The description starts with a configuration example of a sheet feeding apparatus according to the present invention in conjunction with the longitudinal cross sectional view of FIG. 3 showing the mechanical configuration of an image reading apparatus equipped with an ADF (automatic document feeder) in which the sheet feeding apparatus of the present invention is built in.

The image reading apparatus 1 is composed roughly of an optical system 2 and an ADF (Automatic Document Feeder) 3 disposed above the optical system 2, and functions as a scanner unit of a copy apparatus, facsimile apparatus or the like. Note that the image reading apparatus 1 exemplified in FIG. 3 is capable of reading images formed on both surfaces of a document described in detail later.

The optical system 2 comprises a CCD reading unit (CCD: Charge Coupled Device) 11 serving as a first reading unit disposed under a document table 12 which is a plane glass plate (platen glass). The CCD reading unit 11 is fixed at a predetermined position, and is composed of an imaging lens 11*a*, a CCD image sensor 11*b* disposed at a position where an image is focused by the imaging lens 11*a*, and the like. As a result, disposed positions of respective components are determined so that an image of a document supported in plane condition and set on the document table 12 as a plane glass plate is focused at the CCD image sensor 11*b* of the CCD reading unit 11 by a light source unit 13 and a mirror unit 14.

The light source unit 13 comprises a light source 13*a*; a condense mirror 13*b* for condensing illumination light, irradiated from the light source 13*a* for reading, onto a predetermined reading position on the document table 12 from the under side of the document table 12; a slit 13*c* for passing only the reflected light from the document; and a reflecting mirror 13*d* for changing the optical path of the light passed through the slit 13*c* by 90°.

The mirror unit 14 comprises a pair of reflecting mirrors 14*a* and 14*b* with reflecting surfaces arranged orthogonally each other for further changing, by 180°, the optical path from the reflecting mirror 13*d* of the light source unit 13 so as to become the reverse direction and parallel to the document table 12 at further lower position.

As denoted by reference numerals 13*e* and 13*f*, by moving the light source unit 13 in the direction of an arrow 15 in the figure (a sub-scanning direction) parallel to the surface of the document table 12, and similarly by moving the mirror unit 14 in the direction of the arrow 15 (a sub-scanning direction) parallel to the surface of the document table 12, it is configured that the image of a document set on the document table 12 can be read. At this time, it is necessary to adjust the moving speed of the mirror unit 14 to be V/2 when the moving speed of the light source unit 13 is V. These light source unit 13 and mirror unit 14 are moved by a stepping motor 42 not shown (see FIG. 9).

Note that the CCD reading unit 11 may be designed to focus reflected light generated by reflecting the light irradiated from the light source 13*a* by the document onto the CCD image sensor 11*b* through the imaging leans 11*a* while a unit of reduced reading optical system or equal-magnification reading optical system constructed by at least the imaging lens 11*a*, the CCD image sensor 11*b* and the light source 13*a* as one unit scan at moving speed V.

Moreover, this optical system 2 comprises another document table 16 in a position separated by an appropriate distance from the one end portion, specifically one end portion on the left side in FIG. 3, of the document table 12 in the sub-scanning direction. The light source unit 13 can read the image on one surface (hereinafter this surface which is the lower surface on the document table 16 in FIG. 3 is referred to as the front surface) of the document conveyed on the document table 16, in a state in which the light source unit 13 is stationary just under the document table 16 (position shown by reference numeral "Pos1" in FIG. 3). A sheet discharge tray 17 for receiving and stacking documents whose surfaces are read during conveying on the document table 16 is provided near the exit of such documents.

On the other hand, the ADF 3 comprises a CIS (Contact Image Sensor) 21 serving as a second reading unit at a position shown by "Pos2" in FIG. 3 on the upper side of the document table 16. The CIS 21 comprises an image sensor at the under surface thereof for reading image. The ADF 3 picks up one sheet of the documents set in a stacked state on the document tray 22, and causes the CIS 21 to read the image on the other surface (hereinafter this surface which is upper surface on the document table 16 in FIG. 3 is referred to as the rear surface) of the document.

For realizing such functions, the ADF 3 further comprises various rollers R1 through R10, detectors S0 through S8, a curved conveyance path 23, a resist/skew correction area 24, and the like. Note that the CIS 21 is configured as a contact type image sensor comprising, for example, an array image sensor, an array light guiding means (a lens array such as a SELFOC lens), a light source (an LED array light source or a fluorescent lamp), and the like.

Figure 9:
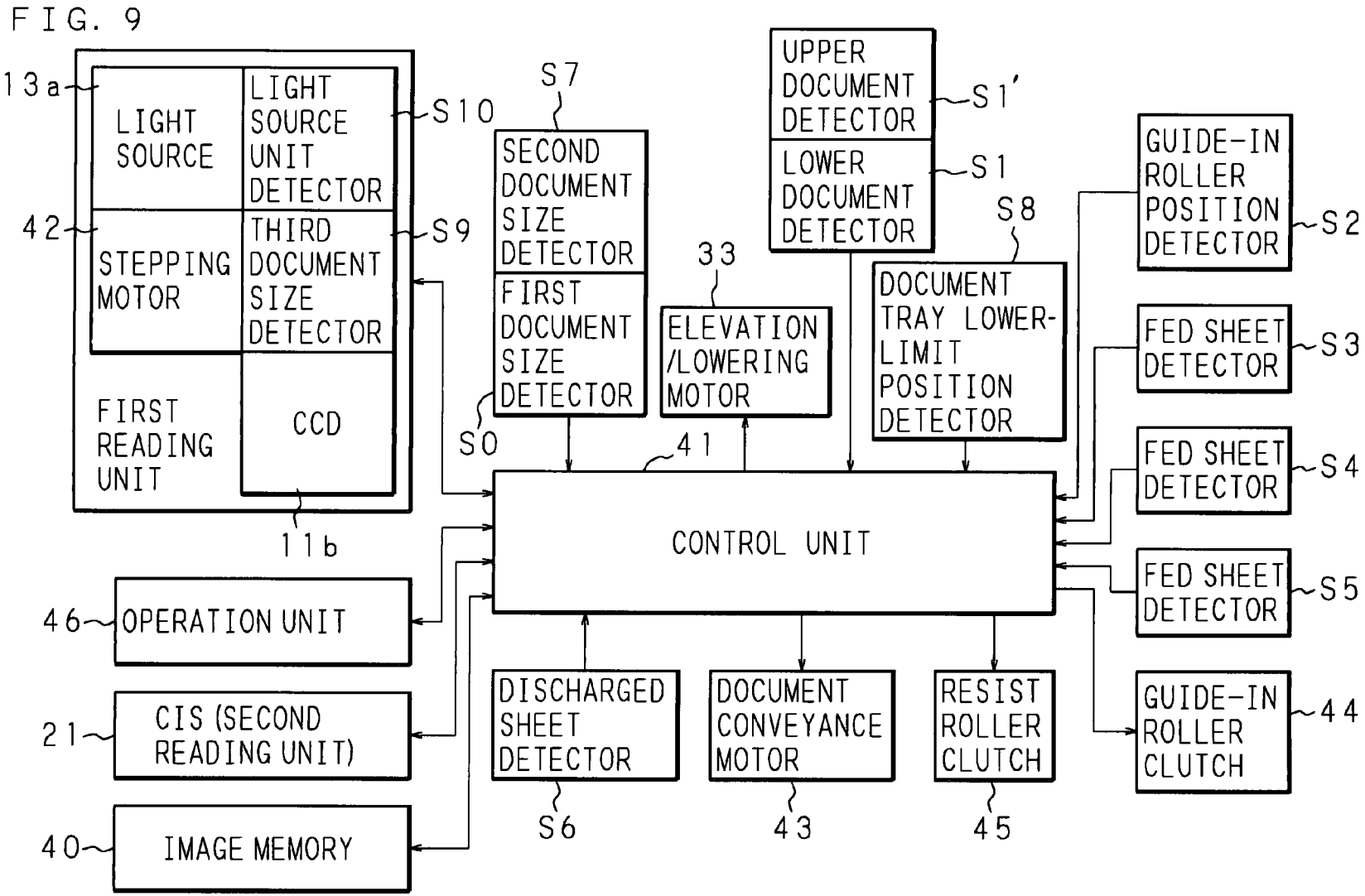
FIG. 9 is a block diagram illustrating functional configuration of an image reading apparatus according to one embodiment of the present invention whose mechanical configuration is shown in FIG. 3.

Note that the various rollers R1 through R10 are driven by a document conveyance motor 43 not shown in FIG. 3 (see FIG. 9). Further, although it is described in detail later, a guide-in roller clutch 44 (see FIG. 9) is connected to the guide-in roller R1 and the separate roller R2 that are connected with transmitting mechanism such as a belt, and a resist roller clutch 45 (see FIG. 9) is connected to either of a pair of resist rollers R8 and R9. By connecting or disconnecting these clutches 44, 45 under the control of a later-described control unit 41 (see FIG. 9), the driving force of the document conveyance motor 43 is transmitted to the guide-in roller R1, separate roller R2 and the pair of resist rollers R8 and R9, or cut off.

The document tray 22 is an electric tray (elevation/lowering tray elevating and lowering by an electric motor). The image reading unit 1 enters standby state for waiting an instruction for reading documents when setting of the documents on the document tray 22 is detected by combination of detecting results of a contact type lower document detector S1 composed of an actuator S1*a* as a contact which rotates by contacting with a leading end of a document having been set on the document tray 22 and a sensor body S1*b* for detecting the rotation of the actuator S1*a*, and a contact type upper document detector S1' composed of an actuator S1*a*' as a contact and a sensor body S1*b*' similar to the actuator S1*a* and the sensor body S1*b*.

Then, the elevation of the document tray 22 starts at a predetermined timing by the control procedure which will be described later in more detail. When elevation of the document tray 22 starts, it reaches a position where the uppermost one of the stack of the documents stored on the document tray 22 presses up the guide-in roller R1 which is supported by an arm 25 capable of elevating and lowering. Simultaneously, the pressing up of the guide-in roller R1 is detected by the guide-in roller position detector S2R1. Then, the elevation of the document tray 22 is stopped and may be kept at the height of the position in the standby state.

Figure 4:
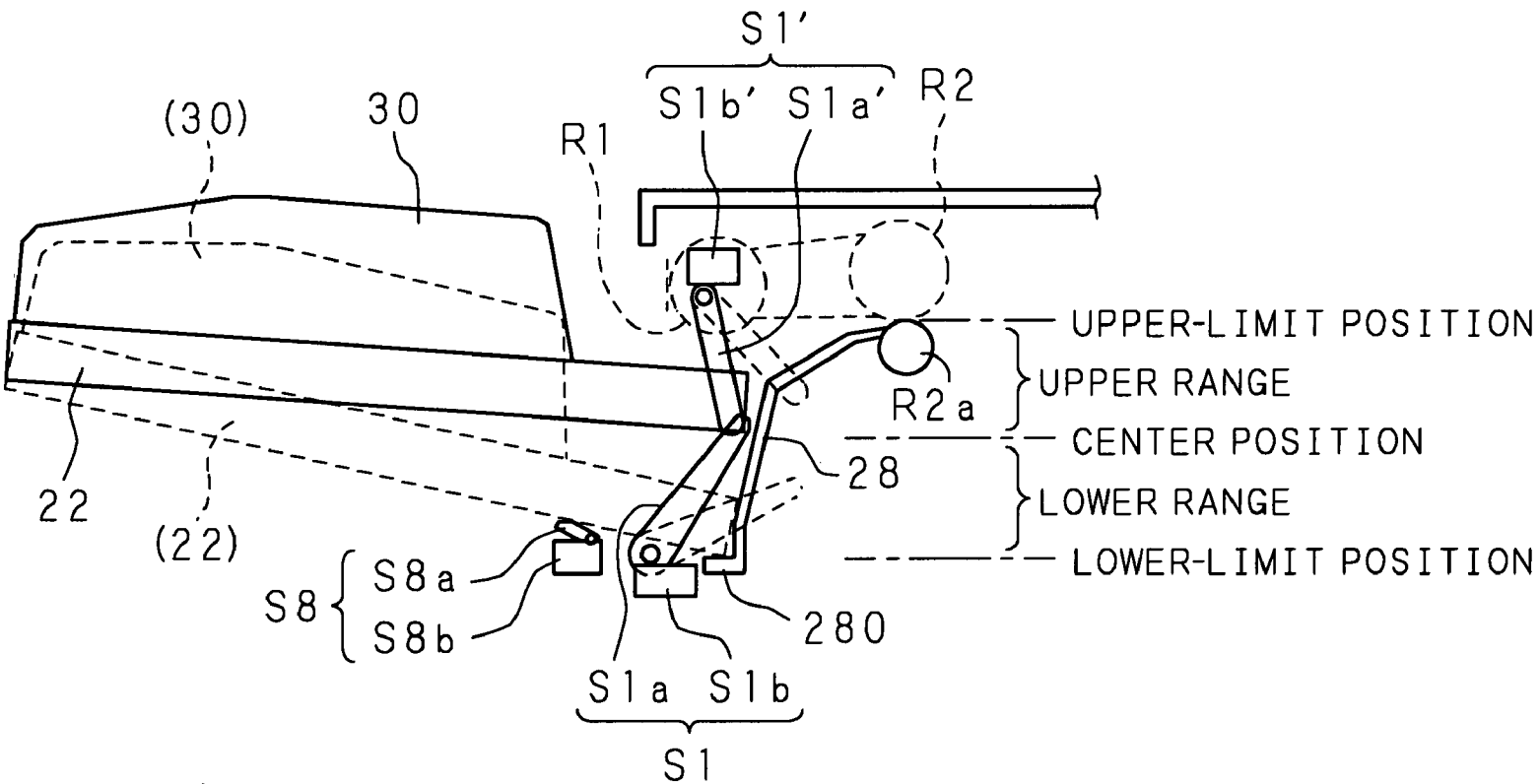
FIG. 4 is a schematic view illustrating an arrangement state and detecting areas of a lower document detector, an upper document detector, and a document tray lower-limit position detector which can detect a document tray being positioned at the lower-limit (reference) position.
Figure 5:
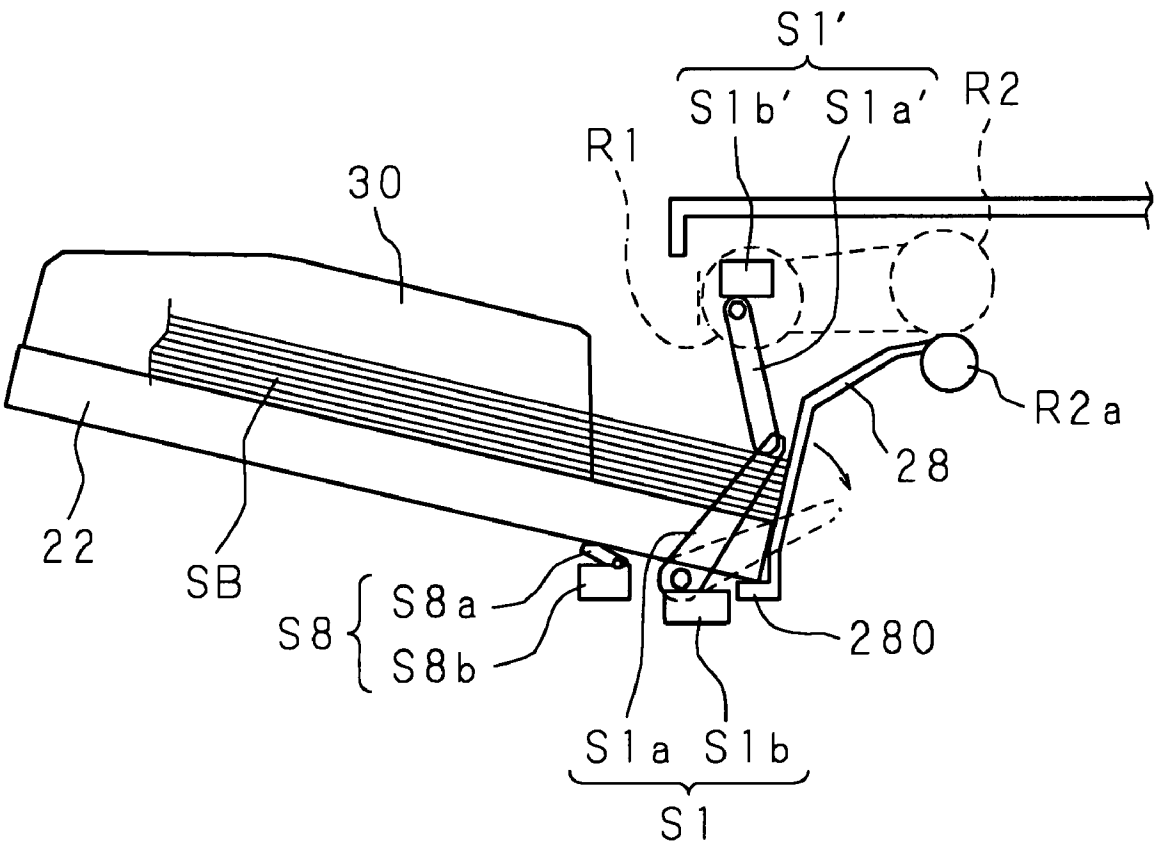
FIG. 5 is a schematic view illustrating an operation state of the lower document detector, the upper document detector, and the document tray lower-limit position detector for detecting the document tray being positioned at the lower-limit (reference) position.
Figure 6:
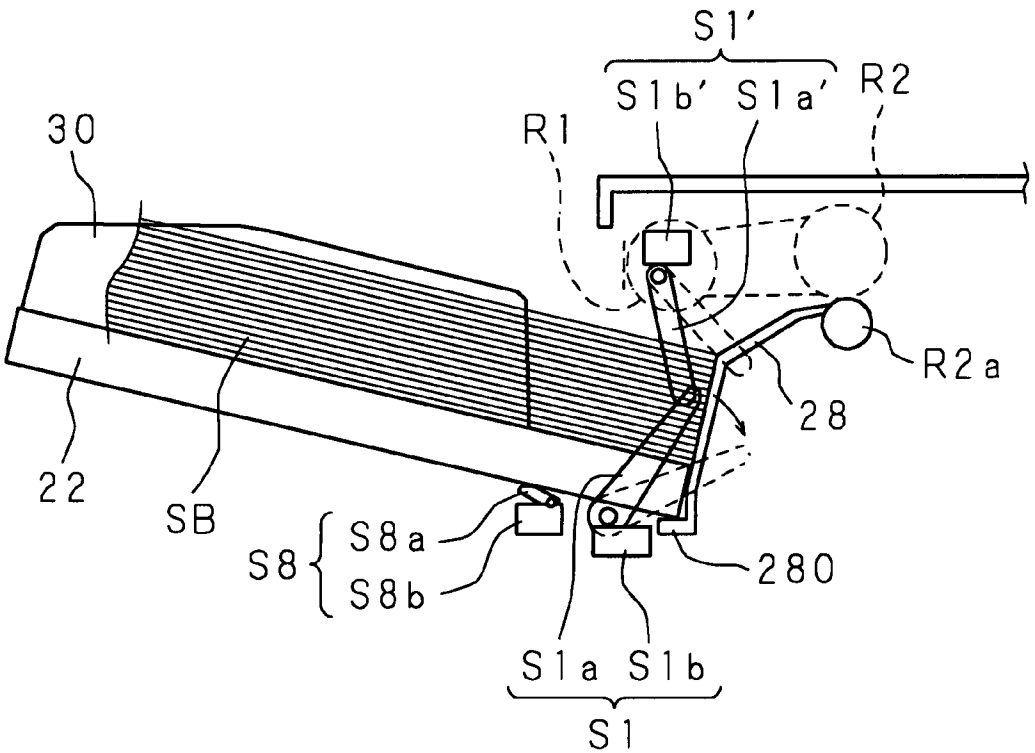
FIG. 6 is a schematic view illustrating an operation state of the lower document detector, the upper document detector, and the document tray lower-limit position detector for detecting the document tray being positioned at the lower-limit (reference) position.
Figure 7:
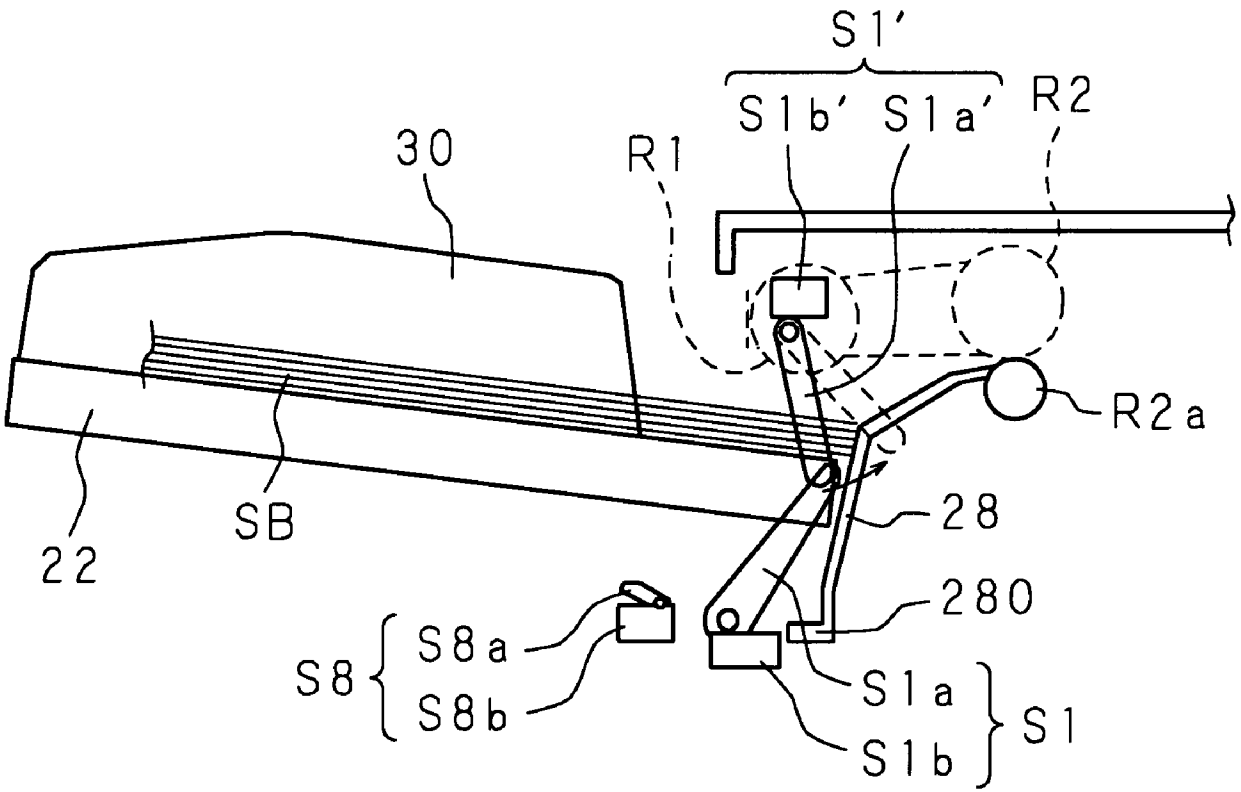
FIG. 7 is a schematic view illustrating an operation state of the lower document detector, the upper document detector, and the document tray lower-limit position detector for detecting the document tray being positioned at the lower-limit (reference) position.

FIG. 4 is a schematic view illustrating an arrangement with their detecting areas of the lower document detector S1, the upper document detector S1', and the document tray lower-limit position detector S8 for detecting that the document tray 22 is positioned at the lower limit position (reference position). FIG. 5 to FIG. 7 are schematic views explaining their operation state.

As shown in FIG. 4, provided beneath the arm 25 is a document leading end regulating plate 28 for correctly setting the documents so as to be a state where the leading ends of the documents on the document tray 22 are uniformly aligned and at a position where the upper side of the uppermost one of the stack of the documents on the documents tray 22 contacts with the under side of the guide-in roller R1 when the document tray 22 elevates. The document leading end regulating plate 28 is formed as a flat plate extending in parallel with the axial direction of the guide-in roller R1 and a lower end thereof bent towards the document tray 22 as a projection which configures as a stopper 280 at the lower-limit position of the document tray 22.

Accordingly, when the document tray 22 lowers, its bottom becomes into contact with the upper side of the stopper 280 to inhibit further downward movement as denoted by the broken line in FIG. 4. In this state, the actuator S8*a* of the document tray lower-limit position detector S8 rotates at a predetermined angle by contacting with the bottom of the document tray 22. By detecting the rotation of the actuator S8*a* by the sensor body S8*b*, the document tray lower-limit position detector S8 detects that the document tray 22 is at its lower-limit position.

The lower document detector S1 is fixed at a position slightly lower than the bottom surface of the document tray 22 so that its sensor body S1*b* does not disturb the document tray 22 at its lower-limit position. Also, the actuator S1*a* as the contact of the lower document detector S1 is a bar-like contact which is directed upwardly and capable of rotating about one end portion as the rotational center at the side of the sensor body S1*b* towards the feeding direction of the documents. The actuator S1*a* of the lower document detector S1 has such a length that its tip end projects slightly upward from the center of the elevation/lowering range of the document tray 22 during its rotation. In other wards, the detection range of the actuator S1*a* of the lower document detector S1 covers to the whole lower range between the lower-limit position and the center position of the elevation/lowering range of the document tray 22 and a portion slightly entering the upper side from this lower range (in the upper half range which will be described later).

Also, the document tray 22 and the document leading end regulating plate 28 have notches provided therein for avoiding the rotation range of the actuator S1*a*, thus permitting no collision of the actuator S1*a* of the lower document detector S1 against the document tray 22 or the document leading end regulating plate 28.

Meanwhile, the upper document detector S1' is also fixed at a position slightly upper than the upper surface of the document tray 22 so that its sensor body S1*b*' does not interrupts the document tray 22 positioned at the upper-limit position (more precisely, where the document tray 22 contacts with the guide-in roller R1 when documents are not set on the document tray 22). The actuator S1*a*' as the contact of the upper document detector S1' is a bar-like contact which is directed downwardly and capable of rotating about one end portion as the rotational center at the side of the sensor body S1*b*' towards the feeding direction of the documents. The actuator S1*a*' of the upper document detector S1' has such a length that its tip end projects slightly downward from the center position of the elevation/lowering range of the document tray 22 during the rotation. In other wards, the detection range of the actuator S1*a*' of the upper document detector S1' covers to the whole upper range between the upper-limit position and the center position of the elevation/lowering range of the document tray 22 and a portion slightly entering the lower side from this upper range.

Also, the document tray 22 and the document leading end regulating plate 28 have notches provided therein for avoiding the rotation range of the actuator S1*a*', thus permitting no collision of the actuator S1*a*' of the upper document detector S1' against the document tray 22 or the document leading end regulating plate 28.

FIG. 5 is a schematic view of a state where a stack of the documents whose quantity makes its uppermost not reach the actuator S1*a*' of the upper document detector S1' when the document tray 22 is at the lower-limit position. In this state, the document tray lower-limit position detector S8 detects that the document tray 22 positions at the lower-limit position. Also, as the actuator S1*a* of the lower document detector S1 rotates because it contacts with the leading end of the stack SB of the documents set on the document tray 22, the lower document detector S1 is turned to the detection (ON) state with its sensor body S1*b* detecting the rotation of the actuator S1*a*. On the other hand, as the actuator S1*a*' of the upper document detector S1' does not rotate because it does not contact with the stack SB of the documents set on the document tray 22, the upper document detector S1' is turned to the non-detection (OFF) state with its sensor body S1*b*' detecting no rotation of the actuator S1*a*'.

FIG. 6 is a schematic view of a state where documents whose quantity makes the uppermost layer of the stack SB of the documents reach the actuator S1*a*' of the upper document detector S1' when the document tray 22 is at the lower-limit position. In this state, the document tray lower-limit position detector S8 detects that the document tray 22 positions at the lower-limit position. Also, as the actuator S1*a* of the lower document detector S1 rotates because it contacts with the leading end of the stack SB of the documents set on the document tray 22, the lower document detector S1 is turned to the detection (ON) state with its sensor body S1*b* detecting the rotation of the actuator S1*a*. Further, as the actuator S1*a*' of the upper document detector S1' rotates because it contacts with the leading end of the stack SB of the documents set on the document tray 22, the upper document detector S1' is turned to the detection (ON) state with its sensor body S1*b*' detecting rotation of the actuator S1*a*'.

FIG. 7 is a schematic view of a state where the document tray 22 gradually elevates and further elevates so that the lowermost one of the stack SB of the documents set on the document tray 22 comes out of the detecting area of the actuator S1*a* of the lower document detector S1 when the stack SB of the documents having a small number of documents are set on the document tray 22, or a state where the stack SB of the documents having a small number of documents is set on the document tray 22 and the document tray 22 is standby state at its illustrated position. In this state, the document tray lower-limit position detector S8 detects that the document tray 22 dos not positions at the lower-limit position. Also, as the actuator S1*a* of the lower document detector S1 does not rotate because it does not contact with the leading end of the stack SB of the documents set on the document tray 22, the lower document detector S1 is turned to the non-detection (OFF) state with its sensor body S1*b* detecting the no rotation of the actuator S1*a*. On the other hand, as the actuator S1*a*' of the upper document detector S1' rotates because it contacts with the leading end of the stack SB of the documents set on the document tray 22, the upper document detector S1' is turned to the detection (ON) state with its sensor body S1*b*' detecting rotation of the actuator S1*a*'.

Figure 8:
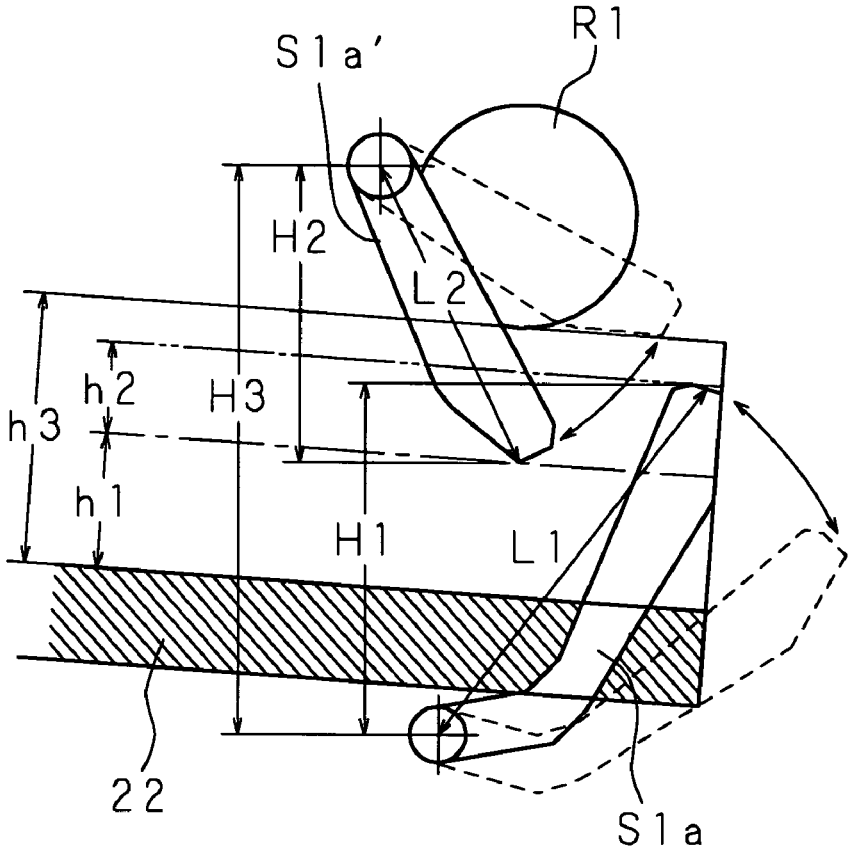
FIG. 8 is a view illustrating an example of the relationship between an actuator of the lower document detector, an actuator of the upper document detector, the distance between the two actuators, and the thickness (height) of a stack of the documents set on the document tray.

FIG. 8 is a view showing an example of the relationship between the rotation of the actuator S1*a* of the lower document detector S1 and the actuator Sla' of the upper document detector S1', and the distance between the two centers of the rotation of both the actuators S1*a* and S1*a*' and the thickness (height) of the stack of the documents set on the document tray 22.

In the example, the effective length (from the rotational center to the tip end) L1 of the actuator S1*a* of the lower document detector S1 is set to 33 mm while the effective length L2 of the actuator S1*a*' of the upper document detector S1' is set to 24 mm. Also, the free height (from the rotational center as the base to the tip end when not in contact with the documents) H1 of the actuator S1*a* of the lower document detector S1 is set to 27 mm while the free height H2 of the actuator S1*a*' of the upper document detector S1' is set to 22 mm. The height H3 extending from the rotational center as the base of the actuator S1*a* of the lower document detector S1 to the rotational center of the actuator S1*a*' of the upper document detector S1' is set to 42 mm.

By setting above data, the height (thickness) h1 of the stack of the documents set on the document tray 22 which is hardly detected with the upper document detector S1' is 10 mm equivalent to 100 sheets of the document. The height (thickness) of the stack of the documents set on the document tray 22 which can be detected with the lower document detector S1 is a sum of h1 and h2 (e.g. 7 mm equivalent to 70 sheets of the document) which is then 17 mm. Assuming that the maximum number of documents to be set on the document tray 22 is 200, the height h3 of the maximum documents set on the document tray 22 is 20 mm. In addition, the relationship between the number of documents and the height (thickness) of it is an approximate based on new and unused PPC paper and is not exactly.

It is noted that the actuator S1*a* of the lower document detector S1 is longer in the effective length than the actuator S1*a*' of the upper document detector S1' because the rotational center of the actuator S1*a* of the lower document detector S1 has to position lower than the bottom of the document tray 22. The longer the length of one of the two actuators, the shorter the length of the other actuator may be determined. It is however preferred in practice that the actuator S1*a*' of the upper document detector S1' other than the actuator S1*a* of the lower document detector S1 is set to a shorter length as it always comes into contact with the documents during the feeding operation.

In case that the document tray 22 set with the document elevates and stays at its standby position for a predetermined period of time after no start signal for the reading operation is entered, its standby state may be held. It is however preferred for preventing any deformation of the guide-in roller R1 to lower the document tray 22 to an appropriate height or the lower-limit position before holding at the standby state.

Then, upon giving a feeding start signal of the document, when the document tray 22 is positioned at a relatively lower position in the standby state, the document tray 22 elevates until the guide-in roller position detector S2 detects that the guide-in roller R1 is pressed up. At this time, the guide-in roller R1 is driven and rotated. As a result, the uppermost one of the stack of the documents set on the document tray 22 will be fed out in a sequence.

The pair of separate rollers R2 and R2*a* are provided at the downstream side of the guide-in roller R1 along the document feeding direction. Meanwhile, the guide-in roller R1 is supported at the tip end of the arm 25, and the portion of the base side of the arm 25 is rotatably supported by the rotational axis of the separate roller R2. As the guide-in roller R1 is downwardly forced by its own weight or any other force, it comes into contact with the uppermost one of the stack of the documents set on the document tray 22. Also, the lower limit position when the guide-in roller R1 lowers is regulated by a stopper (not shown) so as to prevent unnecessary lowering.

The arm 25 has a projection provided on one side thereof which can be detected by the guide-in roller position detector S2 composed of an optical sensor or the like for detecting the height of the guide-in roller R1 based on the angle of rotation of the arm 25. Although the guide-in roller position detector S2 is arranged to directly detect the projection on the arm 25 for detecting the position of the guide-in roller R1 in this embodiment, it may be positioned apart from the arm 25. In the latter case, the height of the arm 25 may be detected with a help of a movable joining mechanism or the like.

The separate roller R2 comprises a roller R2*a* having a torque limiter (a friction pad, for example, may be used instead) which faces and presses the separate roller R2. Thus the documents are surely separated and conveyed one by one without feeding the documents in an overlapped state. Therefore, even when plural sheets of document are picked up by the guide-in roller R1, only the topmost layer of documents adhering to the guide-in roller R1 is picked up by the pair of separate rollers R2 and R2*a*, and is conveyed to the curved conveyance path 23.

Note that whether or not a document was certainly separated and supplied by the pair of separate rollers R2 and R2*a* is detected by the fed sheet detector S3 composed of an actuator S3*a* which rotates by contacting with a document and a sensor body S3*b* for detecting the rotation of the actuator S3*a* based on the time period during which the actuator S3*a* is contacting with a document. Then, the document certainly separated by the pair of separate rollers R2 and R2*a* is conveyed at a predetermined timing to the curved conveyance path 23 on the downstream side.

In the curved conveyance path 23, the document is conveyed by the conveyance rollers R3 through R7. At this time, whether the document is conveyed in the curved conveyance path 23 forcibly or not is detected by the fed sheet detector S4 composed of an actuator S4*a* which rotates by contacting with a leading end of a document and a sensor body S4*b* which detects the rotation of the actuator S4*a* and detects the discharge of the document from the curved conveyance path 23. The curved conveyance path 23 has a curvature capable of conveying any kind of document in a stable manner. Concretely, the curved conveyance path 23 is constructed with a curvature capable of smoothly conveying the thickest document, i.e., the sturdiest document, among readable documents by the image reading apparatus 1.

The document discharged from the curved conveyance path 23 is conveyed to the resist/skew correction area 24. When the leading end of the document is detected by the fed sheet detector S5 positioned in front of the pair of resist rollers R8 and R9 near the exit of the resist/skew correction area 24, rotation of the pair of resist rollers R8 and R9 is once stopped. In this state, the leading end of the document is caused to collide with the joint of the pair of resist rollers R8 and R9 by a conveyance force from the upstream side over a predetermined time, and a resist and skew correction is performed. The fed sheet detector S5 is composed of an actuator S5*a* which rotates by contacting with the leading end of the document and a sensor body S5*b* which detects the rotation of the actuator S5*a*.

The resist/skew correction area 24 extends from the position of the pair of resist rollers R8 and R9 at the most down stream side of the curved conveyance path 23 to the pair of resist rollers R8 and R9. The resist/skew correction area 24 is designed so that a document S is in a substantially straightened condition between the pair of conveyance rollers R6 and R7 and the pair of resist rollers R8 and R9 and is free as much as possible from the guide surface of the conveyance path so as to allow the above-mentioned resist/skew correction of document to be performed in the resist/skew correction area 24 ranging from the pair of conveyance rollers R6 and R7 positioned on the downstream side of the curved conveyance path 23 to the pair of resist rollers R8 and R9. Note that the distance between the pair of conveyance rollers R6 and R7 and the pair of resist rollers R8 and R9 may be set by ensuring at least the length of the smallest document, in the conveying direction, among documents that can be handled by the ADF (document feeder). In other words, the shorter the trailing end portion of the document remaining in the curved conveyance path 23, the smoother the resist/skew correction of document is performed.

The conveyance of the document, for which the resist/skew correction was made in the resist/skew correction area 24 described above, is resumed at a predetermined timing, and the document is conveyed to the first reading position Pos1 for exposing and scanning the front surface of the document. Further, the document passes through a second reading position Pos2 for exposing and scanning the rear surface of the document. The light source unit 13 faces the first reading position Pos1, and the CIS 21 faces the second reading position Pos2.

The document whose image on the front surface or images on both the front and rear surfaces were thus read is discharged onto the sheet discharge tray 17, which is supported on a side surface of the image reading apparatus 1 located in a lower position than the document discharge point, by the pair of discharge rollers R10 and R11 (the discharge roller R10 is provided on the ADF 3 side and the discharge roller R11 is provided on the optical system 2 side). The confirmation of this document discharge operation is detected by the discharged sheet detector S6 composed of an actuator S6*a* which enters rotation state during the document is passing and a sensor body S6*b* which detects the rotation state of the actuator S6*a*.

The above-described operations are repeated one after another until all the documents set on the document tray 22 are fed, and all the documents which have been read are discharged one by one onto the sheet discharge tray 17.

By the way, since the height of the stack of the documents is lowered when the documents are fed one by one, the document tray 22 is controlled to be elevated by an amount corresponding to the lowering of the position of the stack of the documents so as to always keep a predetermined height relationship between the topmost layer of the stack of the documents and the guide-in roller R1. Therefore, the document tray 22 can swing centered by a fulcrum 22*a* provided on the opposite end portion to the guide-in roller R1, and a rib 22*b* provided on the opposite end portion to the fulcrum 22*a* can be elevated by pushing it up by an elevation/lowering plate 31. An end of the elevation/lowering plate 31 opposite to the rib 22*b* is fixed to a plate supporting shaft 32. To the plate supporting shaft 32, an elevation/lowering mechanism unit 34 composed of a transmission member (gear) train and driven and rotated by an elevation/lowering motor 33 is connected. Accordingly, the plate supporting shaft 32 is driven and rotated by the elevation/lowering motor 33 through the elevation/lowering mechanism unit 34, the elevation/lowering plate 31 rotates to push up the rib 22*b* resulting the document tray 22 is elevated, on the other hand, the document tray 22 being lowered by its own weight.

The position (home position denoted by reference numeral HP in FIG. 3) of this document tray 22 during standby state is determined by rotational position of the elevation/lowering plate 31, and driving and controlling the elevation/lowering motor 33 of the elevation/lowering mechanism unit 34 by the later-described control unit, and kept by driving and controlling the elevation/lowering mechanism unit 34 by the later-described control unit on the basis of a detection signal of the guide-in roller position detector S2. The position of the document tray 22 during standby state can be set arbitrarily by a later-described operation unit 46 according to a frequently set number of documents on the document tray 22 in an ordinary general use condition, and can be set suitably by a service person or a user.

Further, the document tray 22 can be elevated/lowered and displaced within a range between the height position of the entrance side and the height position of the exit side of the curved conveyance path 23, which are inevitably formed by the curved conveyance path 23 that was set to guarantee stable conveyance of documents as described above. When the document tray 22 is moved in the lowering direction within this range, the interval between the document tray 22 and the guide-in roller R1 increases, and therefore a large amount of documents can be set and fed one by one by elevating the topmost layer of the large amount of documents set on the document tray 22 to a state capable of being fed to the entrance of the curved conveyance path 23.

Moreover, the document tray 22 has the document regulating plate 30 for regulating the set position of documents by aligning the sides of the documents with user's hand. The position of this document regulating plate 30 is detected by the first document size detector S0 for detecting the width of the document. Note that the document tray 22 is also provided with the second document size detector S7 (see FIG. 9) for detecting the length of the document (the length in the document feed direction). The size of a document set on the document tray 22 is detected by these first and second document size detectors S0 and S7, and a sheet for image forming is selected on the basis of the detection results, and the detection results are also used by the later-described control unit for the control of the height position of the document tray 22.

In the meantime, when reading a document on the document table 12, the light source unit 13 is moved from a position Pos3 (the start position of the light source unit 13 when reading a stationary position) toward a position Pos4 (the return position of the light source unit 13 when reading the largest document) in FIG. 3 by only a predetermined distance according to a document size detected by a third document size detector (not shown in FIG. 3, see FIG. 9) for detecting the size of a document set on the document table 12.

On the other hand, when reading the document with conveying, the light source unit 13 is stopped at the reading position Pos1 (the position of the light source unit 13 when reading a moving document). Moreover, the light source unit 13 uses either a position between the position Pos3 and the position Pos4, or a position between the position Pos3 and the reading position Pos1, as a home position based on the detection result of a light source unit detector serving as the position detector of the light source unit 13. Therefore, when the light source unit 13 is not in use, i.e., is on standby, it is stopped in this home position.

Here, in order to read the document set on the document table 12, a portion of the ADF 3 located on the back side of the image reading apparatus 1 (the back side in FIG. 3) is movably supported by a hinge (not shown) attached between the ADF 3 and the optical system 2. The ADF 3 moves around this hinge as a movement support and opens upward with respect to the document tray 12. In other words, by opening the ADF 3 by moving it upward, the top surface of the document table 12 of the image reading apparatus 1 can be opened from the front side in FIG. 3, and consequently documents of types that can not be conveyed by the ADF 3 because they are not in a sheet form, for example, a book material and a bound document, can be set on the document table 12. Note that a document mat 35 formed of an elastic material is provided on the bottom surface of the ADF 3, i.e., the surface facing the document table 12.

The image reading apparatus 1 thus constructed can read documents in three modes, namely, a stationary read mode, a moving read mode, and a double-side read mode. The stationary read mode is a mode in which the light source unit 13 and the mirror unit 14 are scanned (moved) in the direction shown by the arrow 15 and the image of a document such as a book material set on the document table 12 is read by the CCD reading unit 11. The moving read mode and the double-side read mode are modes in which the images of documents set on the document tray 22 are read by automatically feeding one sheet at a time by the ADF 3. In the moving read mode, the documents are read by the CCD reading unit 11 or the CIS 21, whereas, in the double-side read mode, the images of documents are read using both of the CCD reading unit 11 and the CIS 21.

Note that in this embodiment, the maximum number of documents that can be set on the document tray 22 is around 200 sheets if the documents have a thickness of, for example, an ordinary copy sheet or so.

FIG. 9 is a block diagram showing a functional configuration of the image reading apparatus 1 according to this embodiment whose mechanical configuration is shown in FIG. 3. In FIG. 9, the components same as or corresponding to those shown in FIG. 3 are designated with the same reference numeral, and the explanation thereof is omitted.

To the control unit 41 composed of a microcomputer, etc., the detection results of the first and second document size detectors S0 and S7 for detecting the size of the document set on the document tray 22 and the detection result of the third document size detector S9 disposed on the optical system 2 side for detecting the size of the document set on the document table 12 are supplied. The control unit 41 switches control of the sheet to be used and timing, on the basis of the detection results of these document size detectors S0, S7 and S9.

At the reading of the document using the CCD reading unit 11, the control unit 41 drives and controls the stepping motor 42 to move the light source unit 13 and the mirror unit 14 as described above, and controls the light source 13*a* and the CCD image sensor 11*b* according to the position of the light source unit 13 detected by the light source unit detector S10 so as to read the image of the document.

On the other hand, in the reading of the document using the ADF 3, the control unit 41 drives and controls the elevation/lowering motor 33 on the basis of the detection result of the guide-in roller position detector S2; keeps the topmost surface of a stack of the documents set on the document tray 22 at a fixed height; conveys the documents by controlling the document conveyance motor 43, the guide-in roller clutch 44 and the resist roller clutch 45 based on the detection results of each detector S3 through S6 until the lower document detector S1 and the upper document detector S1' detect that all the documents on the document tray 22 have been fed; and reads the images of the documents by controlling the CCD image sensor 11*b* and/or the CIS 21.

Moreover, the control unit 41 displays necessary information on the operation unit 46 (see FIG. 10) composed of a liquid crystal touch panel, etc., and receives an input operation applied to the operation unit 46.

Further, reference numeral 40 denotes an image memory which is used for storing image data read described above. Processing procedure for using the image memory 40 is described later.

Figure 10:
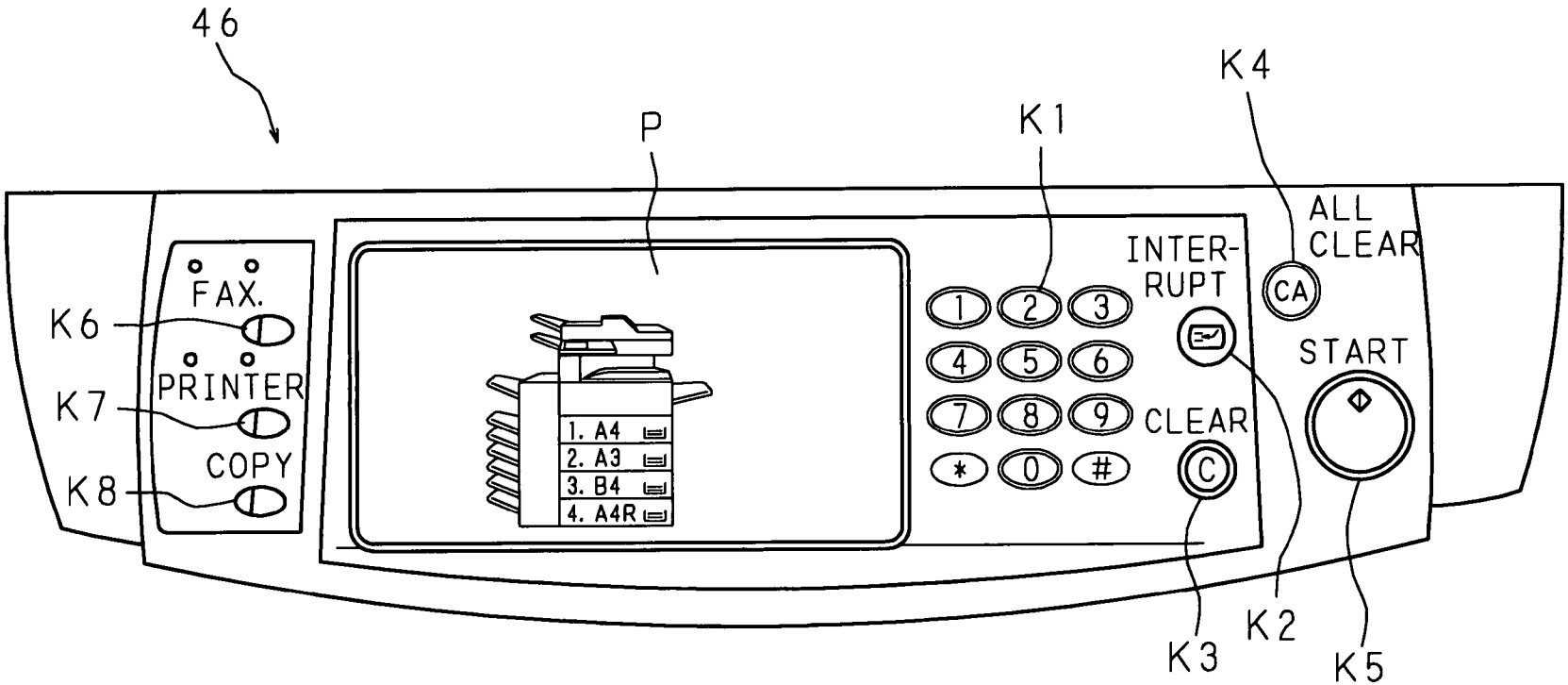
FIG. 10 is a schematic view illustrating a configuration example of an operation unit of the image reading apparatus of the present invention.

FIG. 10 is a schematic view showing an example of the structure of the operation unit 46 of the image reading apparatus 1 according to the present invention. Although not shown in FIG. 3, the operation unit 46 is positioned on the top surface of the image reading apparatus 1, and comprises various keys K1 through K8 and an operation panel P composed of a liquid crystal touch panel or the like.

The various keys K1 through K8 provided in the operation unit 46 include K1 as a ten-key keypad for inputting numerals, K2 as an Interrupt key for interruption processing, K3 as a Clear key, K4 as an All Clear (all delete) key, K5 as a Start key for starting to read a document, and K6, K7 and K8 as function switching keys for selecting a facsimile function, a printer function and a copy function, respectively. Note that when the image reading apparatus 1 of the invention is built in a digital multiple function printer (MFP) 100, the digital multiple function printer 100 functions as a copy apparatus by operation of the copy key K8. In this case, the Start key K5 functions as a key for instructing to start copy.

On the operation panel P various screens are displayed and changed. In theses screens, touch keys for setting various conditions, and various condition setting is possible when user directly pushes those touch keys. Further, the operation panel P is constructed so as to display various guidance and warnings for operation.

Figure 11:
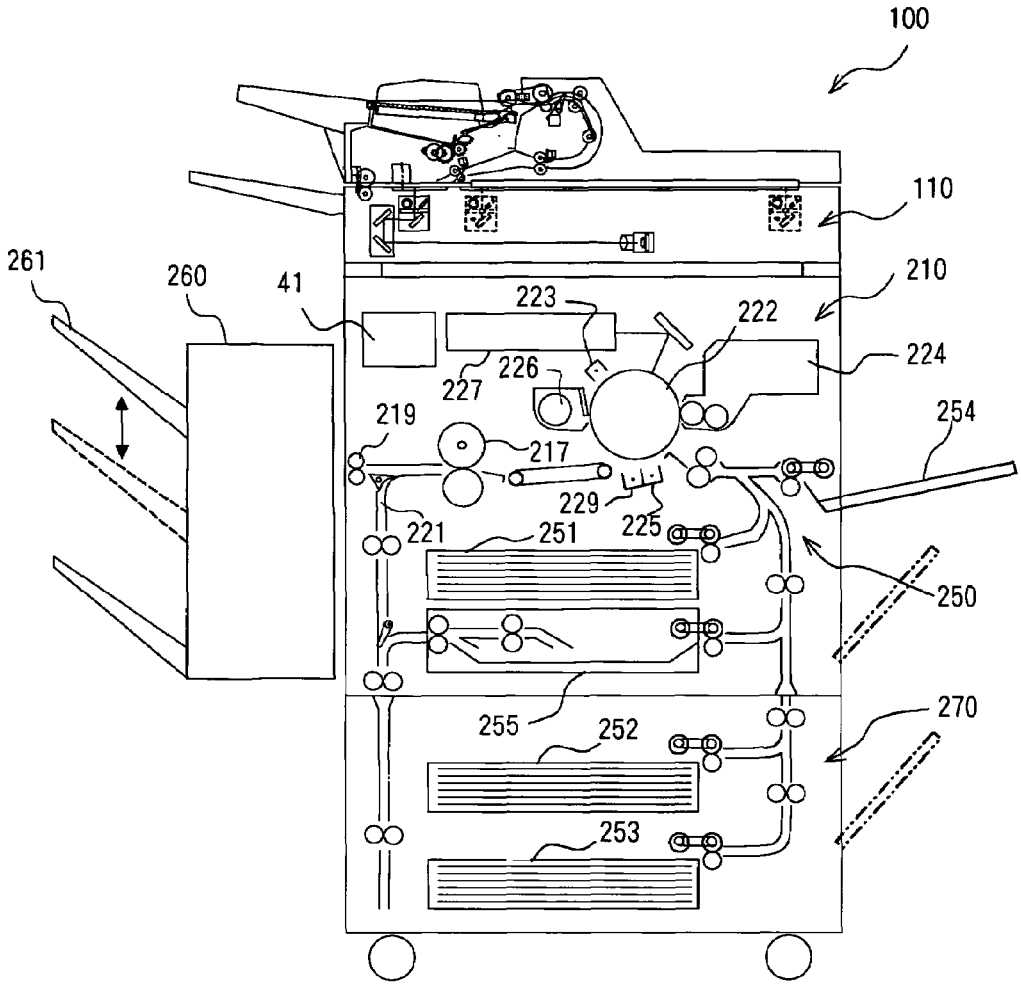
FIG. 11 is a longitudinal cross sectional view of a digital multiple function printer as an image forming apparatus for forming an image by reading an image of a document by the image reading apparatus of the present invention.

FIG. 11 is a vertical cross sectional view showing the schematic configuration of the digital multiple function printer 100 as an image forming apparatus for reading image of the document and forming image by above-mentioned image reading apparatus. In such the image forming apparatus, above-mentioned sheet feeding apparatus of the present invention is built in not only the image reading unit for reading image from sheet-like document but also a construction for supplying recording sheet (sheet-like copy paper) to an image forming apparatus.

In the digital multiple function printer 100, the image reading apparatus 1 shown in FIG. 3 mentioned above is built in as the reading unit 110. Document image read by the reading unit 110 is transferred as an image data to an image data inputting unit (not shown), and predetermined image processing is performed on the image data, then the image data is stored temporarily in the image memory 40 shown in FIG. 9. Thereafter, when an output instruction is given, the image data stored in the image memory 40 is read and transmitted to a laser writing unit 227 that is an optical writing apparatus of an image forming unit 210.

The laser writing unit 227 comprises a semiconductor laser light source for emitting laser light according to the image data transferred from the image memory 40 or external device; a polygon mirror for deflecting the laser light at equal angular velocity; and a f-0 lens for correcting the laser light deflected at equal angular velocity so that the laser light is deflected at equal angular velocity on a photoconductor drum 222. Note that although this embodiment uses the laser writing unit 227 as the optical writing apparatus, it may be possible to employ a fixed scanning type optical writing head unit using a light emitting element array, such as LED (Light Emitting Diode) and EL (Electro Luminescence).

Disposed around the photoconductor drum 222 are an electrizer 223 for charging the photoconductor drum 222 to an predetermined electric potential; a developing device 224 for developing an electrostatic latent image formed on the photoconductor drum 222 into a visible image by supplying toner to the electrostatic latent image; a transfer device (transfer charger, etc.) 225 for transferring a toner image formed on the surface of the photoconductor drum 222 to a recording sheet; a cleaning device 226 for removing the remaining toner on the photoconductor drum 222 after the transfer of the toner image; and a discharging device (discharger) 229 for removing electric charges from the photoconductor drum 222 from which the toner image has been transferred. The recording sheet to which toner image is transferred is conveyed to the fixing unit 217 and toner image is fixed to the recording sheet by heat pressing process.

There are provided in addition to the above mentioned fixing unit 217 at the discharge side of the image forming unit 210 a switch-back path 221 for inverting a recording sheet upside down to form an image on the back side of the recording sheet and a post-processing unit 260 equipped with a up/down tray 261 for stapling the recording sheet on which the image is formed. As necessary, the recording sheet on which the toner image is fixed at the fixing unit 217 is passed through the switch-back path 221, conveyed to the post-processing unit 260 by the operation of a discharge roller 219 where it is post-processed, and discharged into the up/down tray 261.

A sheet feeding unit is provided beneath the image forming unit 210. The sheet feeding unit is composed of a hand-feed tray 254, a both-side unit 255, and a sheet tray 251 provided in the body of the digital multiple function printer 100, and a group of different sheet trays 252 and 253 provided in a multi-tray feeder 270 which can be separated from the digital multiple function printer 100. In the body of the digital multiple function printer 100, a transfer mechanism 250 is provided for transferring the recording sheets from the trays 251, 252, 253 and 254 to a transfer position where a transfer device 225 of the image forming unit 210 is located.

The both-side unit 255 is also communicated with the switch-back path 221 for inverting the recording sheet upside down thus to form images on both sides of the recording sheet. The both-side unit 255 may be replaced with a common sheet cassette. Also, a large volume sheet tray for storing as a larger number of sheets as several thousands may be provided as not shown.

The digital multiple function printer 100 shown in FIG. 11 includes the control unit 41 as well as other functional blocks shown in FIG. 9.

The operation of the digital multiple function printer 100 equipped with the sheet feeding apparatus of the present invention will now be described for one example procedure by the control unit 41 referring to the flowcharts of FIG. 12 and FIG. 13.

The control unit 41 determines by a detection result given from the document tray lower-limit position detector S8 whether or not the document tray 22 is at its lower-limit position when the digital multiple function printer 100 is switched on and stays at the standby state (Step S11). When the document tray 22 is not at the lower-limit position (No at Step S11), the control unit 41 controls the elevation/lowering motor 33 to lower the document tray 22 to the lower-limit position (Step S12). At this time, the processes of steps S11 and S12 are repeated until the document tray 22 comes at the bottom of the front end into contact with the stopper 280 and its contact is detected by the document tray lower-limit position detector S8.

When the document tray 22 is at the lower-limit position (Yes at Step S11), the control unit 41 holds the state (Step S13). More specifically, when operation for lowering the document tray 22 is executed, the control unit 41 stops the elevation/lowering motor 33 to stop lowering the document tray 22. When the document tray 22 is already at the lower-limit position, the control unit 41 controls no operation.

Next, the control unit 41 determines a detection result of the lower document detector S1 (Step S14). When the detection result of the lower document detector S1 is not at the detection (ON) state but at the non-detection (OFF) state (No at Step S14), the control unit 41 then determines a detection result of the upper document detector S1' (Step S15). When the detection result of the upper document detector S1' is not at the detection (ON) state but at the non-detection (OFF) state (No at Step S15), the control unit 41 determines that no document is set on the document tray 22 and returns the process to Step S11.

On the other hand, when the detection result of the upper document detector S1' is at the detection (ON) state (Yes at Step S15), the control unit 41 determines that the documents are not correctly set on the document tray 22 and displays a guidance on the operation panel P of the operation unit 46 for confirming the set condition of the documents on the document tray 22 (Step S16). Then, the control unit 41 returns the process to Step S11.

When it is judged "YES" at Step S14 described above, that is, the detection result of the lower document detector S1 is at the detection (ON) state, the control unit 41 then determines the detection result of the upper document detector S1' (Step S17). When it is determined that the detection result of the upper document detector S1' is at the detection (ON) state (Yes at Step S17), the control unit 41 determines from both the detection (ON) states of the upper document detector S1' and the lower document detector S1 that a sufficient number of documents are set on the document tray 22 as shown in FIG. 6 where the presence of the documents is successfully detected by not only the lower document detector S1 but also the upper document detector S1'. In this case, the control unit 41 reserves a relatively large area in the image memory 40 for storage of the read data (Step S18). Simultaneously, the control unit 41 inhibits any other processing requiring the use in the image memory 40, for example, receiving of image data transmitted from the external through the communication network (Step S19).

On the other hand, when it is judged that the detection result of the upper document detector S1' is at the non-detection (OFF) state (No at Step S17), the control unit 41 determines from the detection (ON) state of the lower document detector S1 that a smaller number of documents are set on the document tray 22 as shown in FIG. 5 where the presence of documents is detected by only the lower document detector S1. In this case, the control unit 41 reserves a relatively small area in the image memory 40 for storage of the read data (Step S20). Simultaneously, the control unit 41 permits another processing requiring the use in the image memory 40, for example, receiving image data from the external through the communication network (Step S21).

When the process at Step S19 or S21 has been executed, the control unit 41 starts elevation of the document tray 22 by controlling the elevation/lowering motor 33 (Step S22) and determines a detection state of the guide-in roller position detector S2 (Step S23). At the beginning, the detection state of the guide-in roller position detector S2 is non-detection state (OFF) (No at Step S23). As the document tray 22 elevates and reaches at a position for pressing up the guide-in roller R1 with the uppermost layer of the stack of the documents, this state is detected (ON) by the guide-in roller position detector S2 (Yes at Step S23). At this time, the control unit 41 executes control for stopping the elevation/lowering motor 33 to stop the elevation of the document tray 22 (Step S24), and once enters the standby state. Then, according to a start signal generated by, for example, depressing the start key K5 on the operation unit 46, the control unit 41 starts the feeding and conveying documents and reads document images (Step S25).

Figure 12:
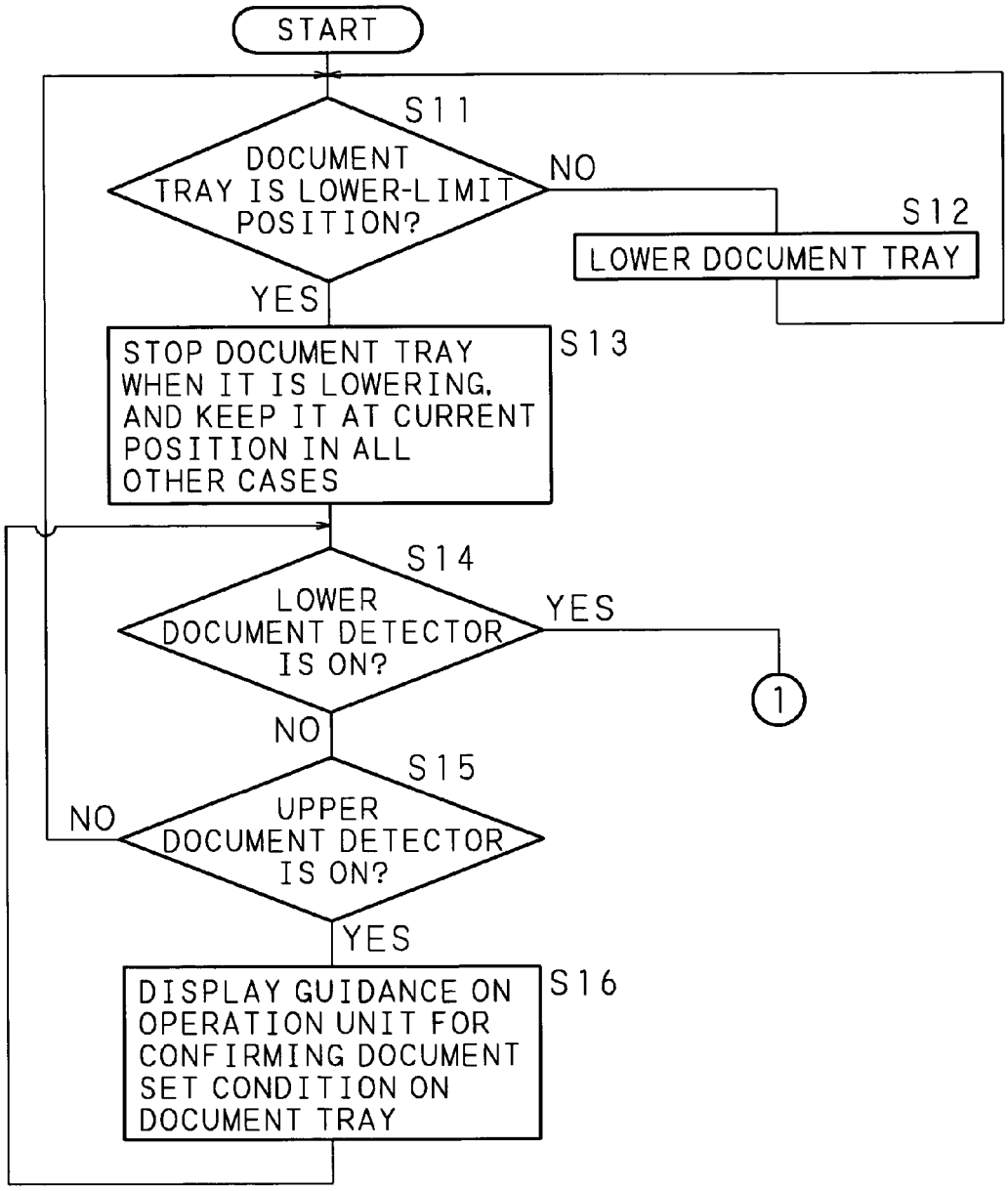
Figure 13:
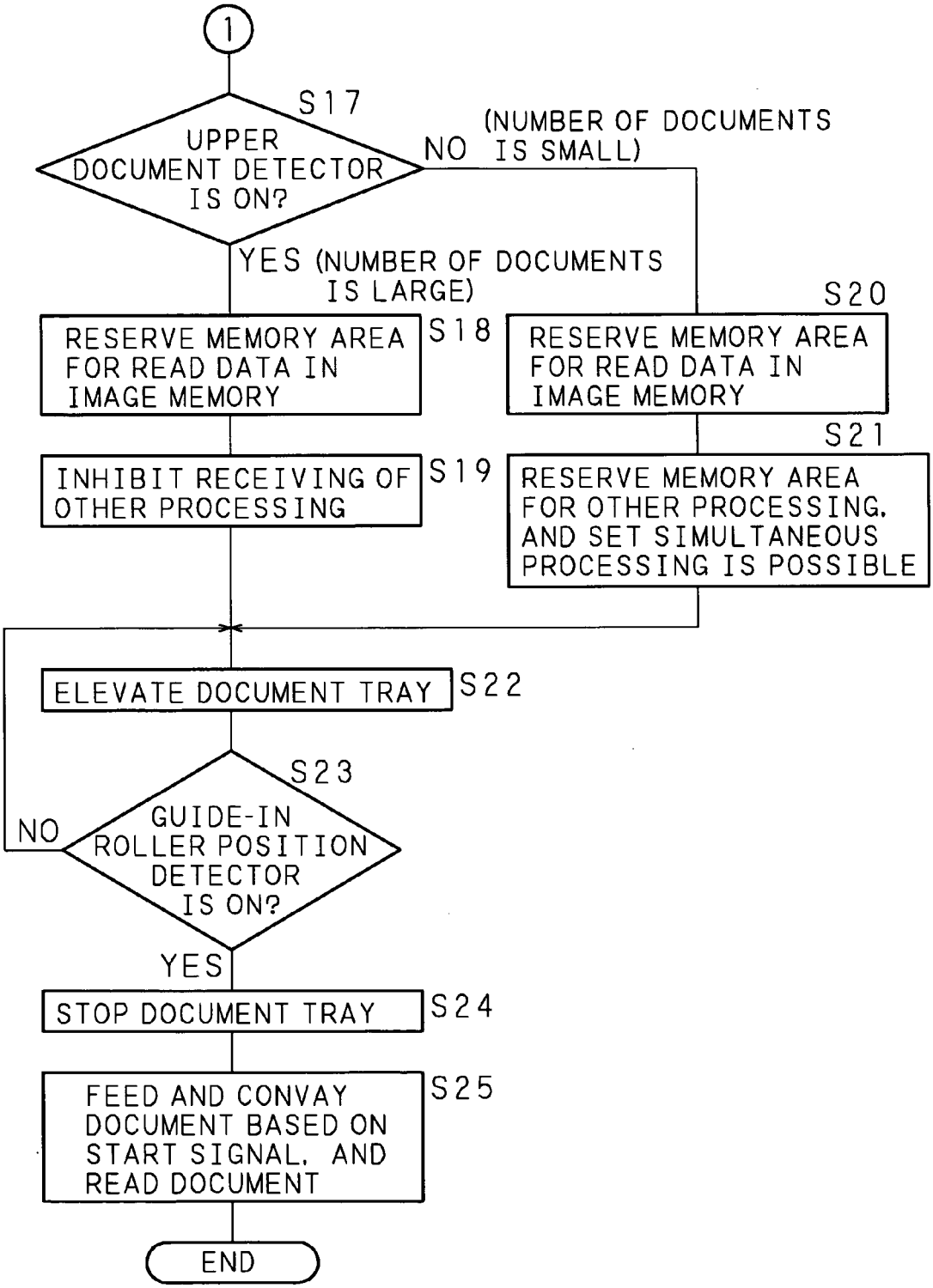

Accordingly, in the procedure shown in the flowcharts of FIG. 12 and FIG. 13, based on the detection states of the lower document detector S1 and the upper document detector S1', that is, each detector detects or not that documents are set on the document tray 22, the control unit 41 can determine the state where the documents are not correctly set, the state where a relatively large number of documents are set, or the state where a relatively small number of documents are set.

The control unit 41 then generates a warning when judging the state where documents are not correctly set, and prepares for reserving a relatively large area in the image memory 40 for storage of the read data when judging the state where a relatively large number of documents are set, or reserving a relatively small storage area in the image memory 40 when judging the state where a relatively small number of documents are set.

The storage capacity of the image memory 40 will now be explained in brief. It is assumed that the image data of an A4 size document is about 4 MB before subjected to compression. For storage of all the data read from two hundreds of A3 size documents, the image memory 40 has to store a storage area of substantially 1.6 GB. It is assumed that the capacity of the image memory 40 is 1.6 GB, when the control unit 41 judges at Step S17 that a smaller number or not larger than 100 of the documents are set on the document tray 22 and the first and second document size detectors S0 and S7 determine that the size of the document sheets is A4, the image memory 40 has to store a storage area of substantially 400 MB. It is hence desired to provide a storage area of 512 MB of the image memory 40 for storage of the read data. As the remaining storage area in the image memory 40 is allocated for another external data transmitted from the external through the communication network or the like, the simultaneous processing operation can be conducted.

Figure 14:
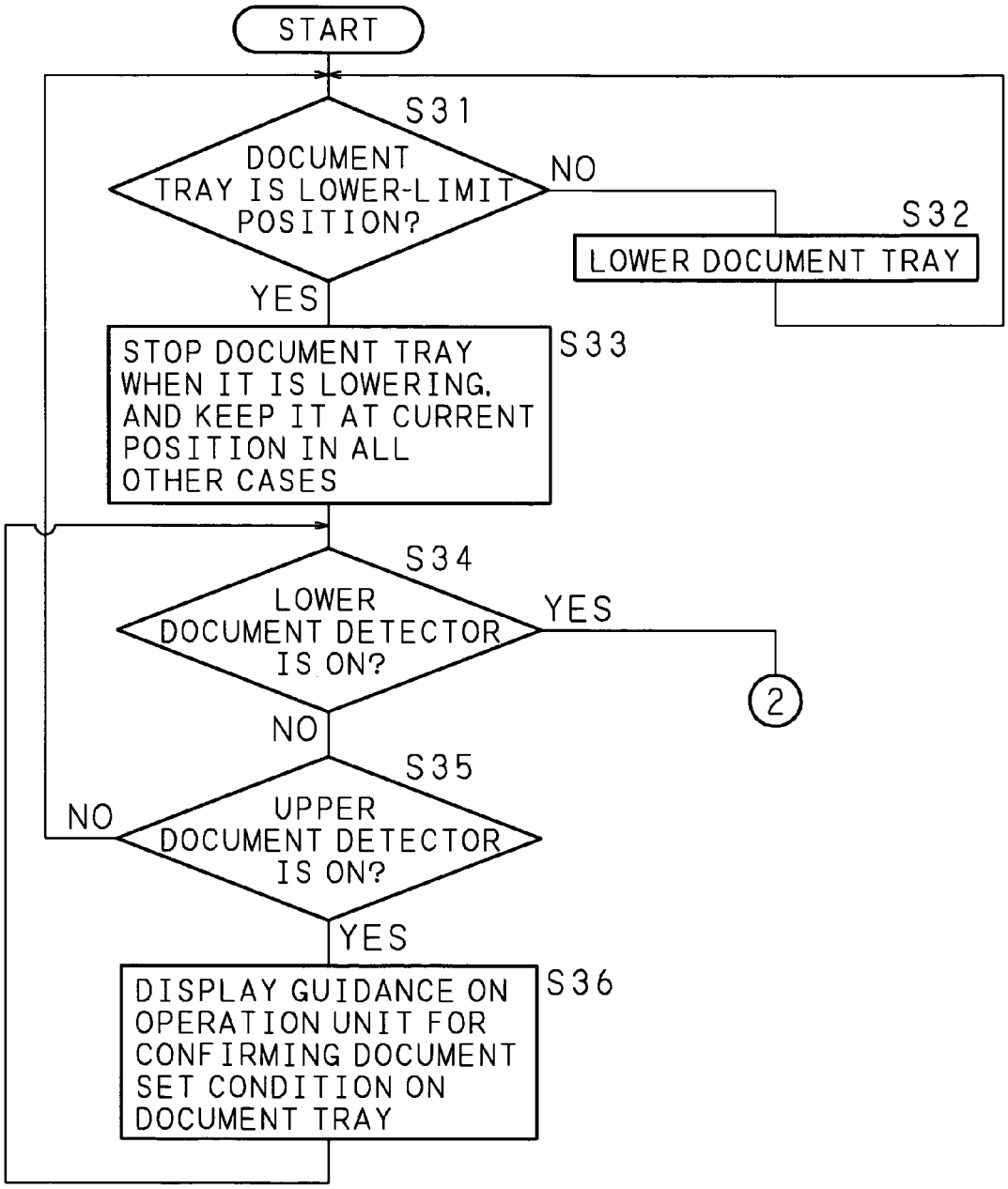
Figure 15:
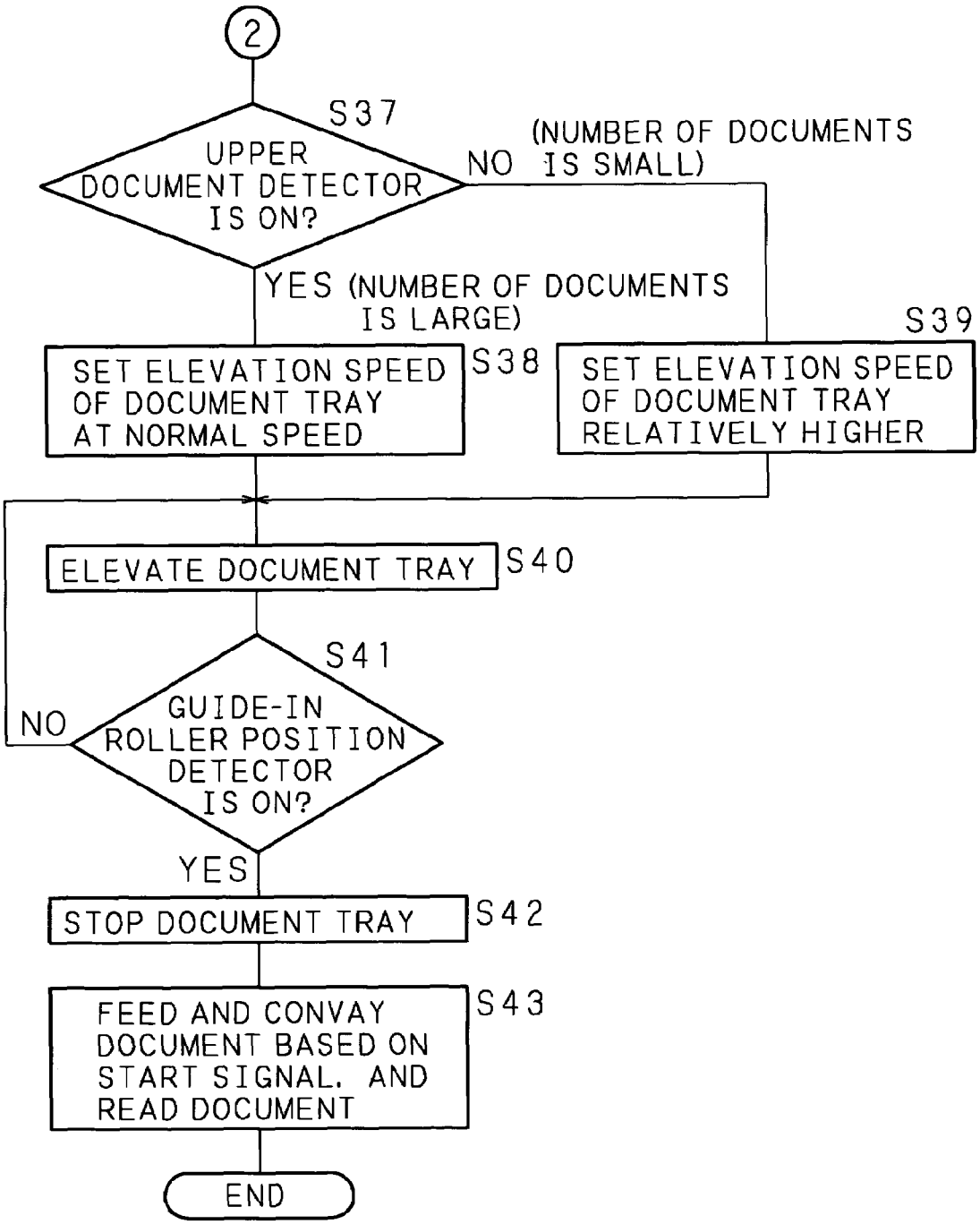

Next, another example of the operation by the control unit 41 in the digital multiple function printer 100 equipped with the sheet feeding apparatus of the present invention will be explained referring to the flowcharts of FIG. 14 and FIG. 15. The steps S31 to S37 in the flowcharts of FIG. 14 and FIG. 15 are identical to the steps S11 to S17 in the flowcharts of FIG. 12 and FIG. 13 and will be explained in no more detail. The procedure in the flowcharts of FIG. 14 and FIG. 15 will be explained after it is judged "YES" at Step S34 as the step S14 has determined "YES" in the flowcharts of FIG. 12 and FIG. 13.

When it is judged "YES" at Step S34, that is, the detection result of the lower document detector S1 is at the detection (ON) state, the control unit 41 determines a detection result of the upper document detector S1' (Step S37). When the detection result of the upper document detector S1' is at the detection (ON) state (Yes at Step S37), the control unit 41 judges that a relatively large number of documents is set on the document tray 22, i.e., the presence of documents is detected by not only the lower document detector S1 but also the upper document detector S1' as shown in FIG. 6. In this case, since the distance between the uppermost layer of the stack of the documents set on the document tray 22 and the guide-in roller R1 is relatively small, the control unit 41 set the control condition of the elevation/lowering motor 33 for elevating the document tray 22 at a speed set as a normal elevation speed (Step S38).

On the other hand, when it is judged that the detection result of the upper document detector S1' at Step S37 is at the non-detection (OFF) state (No at Step S37), the control unit 41 determines from only the detection result of the lower document detector S1 at the detection (ON) state that a relatively small number of documents are set on the document tray 22, i.e., the presence of documents is detected by only the lower document detector S1 as shown in FIG. 5. In this case, since the distance between the uppermost layer of the stack of the documents set on the document tray 22 and the guide-in roller R1 is relatively large, the control unit 41 set the control condition of the elevation/lowering motor 33 for elevating the document tray 22 at a higher speed than the speed set as the normal elevation speed (Step S39).

The control unit 41 then controls the elevation/lowering motor 33 according to the elevation speed of the document tray 22 determined by Step S38 or S39 (Step S40), and determines a detection state of the guide-in roller position detector S2 (Step S41). At the beginning, the detection state of the guide-in roller position detector S2 is at the non-detection (OFF) state (No at Step S41). As the document tray 22 elevates to push up the guide-in roller R1 with the uppermost layer of the stack of the documents, this state is detected (ON) by the guide-in roller position detector S2 (Yes at Step S41). At this time, the control unit 41 executes control for stopping the elevation/lowering motor 33 to stop the elevation of the document tray 22 (Step S42), and once enters the standby state. Then, according to a start signal generated by, for example, depressing the start key K5 on the operation unit 46, the control unit 41 starts the feeding and conveying documents and reads document images (Step S43).

Accordingly, in the procedure shown in the flowcharts of FIG. 14 and FIG. 15, based on the detection states of the lower document detector S1 and the upper document detector S1', that is, each detector detects or not that documents are set on the document tray 22, similar to the procedure shown in the flowcharts of FIG. 12 and FIG. 13, the control unit 41 can determine the state where the documents are not correctly set, the state where a relatively large number of documents are set, or the state where a relatively small number of documents are set.

In the procedure shown in FIG. 14 and FIG. 15, the control unit 41 generates a warning when judging the state where documents are not correctly set, and sets the elevation speed of the document tray 22 to the normal speed when judging the state where relatively large number of documents are set, or sets the elevation speed of the same at higher than the normal speed when judging the state where relatively small number of documents are set. This permits the document tray 22 to be elevated at the higher speed throughout the relatively large distance between the uppermost layer of the stack of the documents and the guide-in roller R1 when the number of documents set on the document tray 22 is relatively small. As the document tray 22 is elevated at the higher speed, feeding and conveying the documents can be quickly started.

Figure 16A:
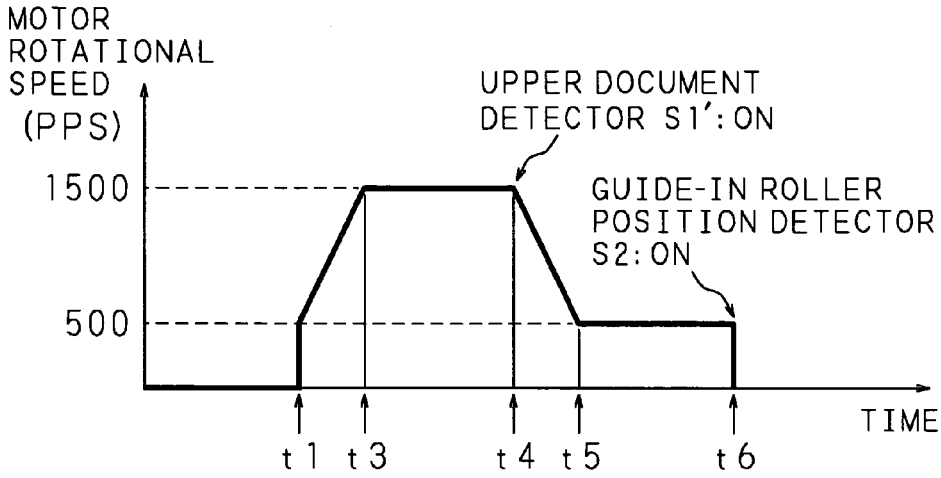
FIG. 16A and FIG. 16B are graphic diagrams showing control states (control states of the rotational speed of the motor) of an elevation/lowering motor in the flowcharts of FIG. 14 and FIG. 15.
Figure 16B:
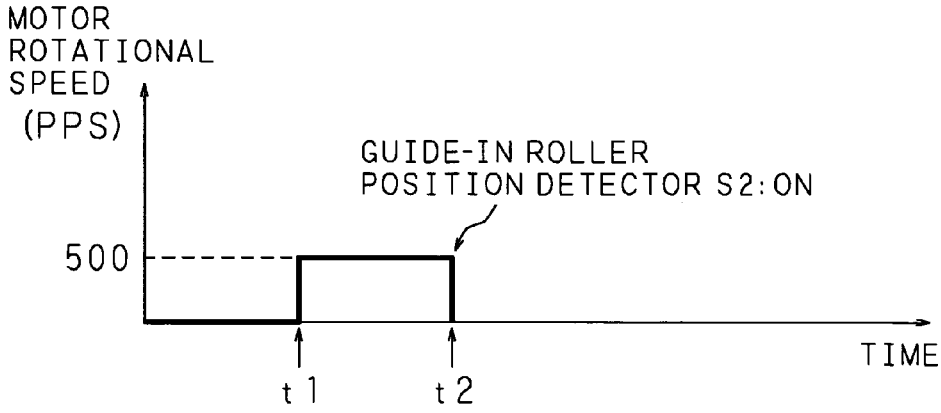

FIG. 16A and FIG. 16B are graphic diagrams showing the control states (the control states of the rotational speed) of the elevation/lowering motor 33 at Steps S38 and S39 in the flowcharts of FIG. 14 and FIG. 15. At the control for elevating the document tray 22 at the normal elevation speed executed at Step S38, the elevation/lowering motor 33 is rotated with a constant rate of 500 pps (pulses per second) from the time t1 to t2 as shown in FIG. 16B. The time t1 is the time when the control unit 41 judges at Step S37 that the upper document detector S1' is at the detection (ON) state. Similarly, the time t2 is the time when the control unit 41 judges at Step S41 that the guide-in roller position detector S2 is at the detection (ON) state.

On the other hand, at the control for elevating the document S36 as shown in FIG. 16A, the elevation/lowering motor 33 is activated at 500 pps at the time t1 and increased its rotational speed up to 1500 pps and then becomes constant speed. Although not shown in the flowcharts of FIG. 14 and FIG. 15, the rotational speed of the elevation/lowering motor 33 begins to decrease its rotational speed to 500 pps from the time t4 when the upper document detector S1' is turned to the detection (ON) state, and then stops at the time t6 when the control unit 41 judges that the guide-in roller position detector S2 is turned to the detection (ON) state.

While the procedure in the flowcharts of FIG. 12 and FIG. 13 and the procedure in the flowcharts of FIG. 14 and FIG. 15 are described separately for conducting different operations, they may simultaneously be executed in a parallel processing mode.

As described above, according to the sheet feeding apparatus of the present invention, the actuator (contact) of the sensor (detector) for detecting a stack of the documents stored (set) on the document tray 22 is separated into two parts and provided at both upper and lower sides of the document tray 22. This can minimize the length of both the actuators S1*a* and S1*a*'. Also, as any undesired sheet which is curled upwardly is detected with the actuator S1*a*' of the upper document detector S1', the detecting operation will generate minimum error.

Further, according to the sheet feeding apparatus of the present invention, the detecting areas of the two actuators S1*a* and S1*a*' of the upper and lower document detectors S1 and S1' partially overlap each other, thus creating no undetectable area. Also, since the overlap area between the two detecting areas of the upper and lower document detectors S1 and S1' is sufficiently increased, the detecting operation can be stable regardless of any discrepancy in the characteristics of the document detectors S1 and S1'.

Further, according to the sheet feeding apparatus of the present invention, when number of the sheets stored on the document tray 22 increases, the control unit 41 controls the height of the uppermost of the sheets stored on the document tray 22 to keep at a predetermined height. Accordingly, the sheets can be fed out one by one from the uppermost one, hence ensuring the stability of the feeding operation. Also, as the document tray 22 is elevated or lowered within the detecting areas of the two document detectors S1 and S1', the document sheets can certainly be detected for their presence or absence regardless of the position of the document tray 22.

Further, according to the sheet feeding apparatus of the present invention, the volume of the sheets stored in the document tray 22 is roughly determined by combining the two detection results of the upper and lower document detectors S1 and S1'. More particularly, it is judged that the number of the sheets is small when the upper document detector S1' detects the presence of the sheets and the lower document detector S1 detects the absence of the sheets in the document tray 22. It is judged that the number of the sheets is large when both the upper and lower document detectors S1' and S1 detect the presence of the sheets. It is hence judged that no sheet is set in the document tray 22 when both the upper and lower document detectors S1' and S1 detect the absence of the sheets. Also, it is judged that the number of the sheets is small in the document tray 22 positioned at upper when only the lower document detector S1 detects the presence of the sheets. On the contrary, it is judged that the number of the sheets is small in the document tray 22 positioned at lower when only the upper document detector S1' detects the presence of the sheets.

Further, according to the sheet feeding apparatus of the present invention, the control unit 41 controls the elevation/lowering motor 33 to elevate or lower the document tray 22 at a higher speed to the corresponding position where the sheets can be picked up from the document tray 22 when it is judged that the number of the sheets is small in the document tray 22 located at its lower-limit position where a maximum of the sheets can be loaded.

Also, the image reading apparatus of the present invention can hence be realized featuring the advantages of the sheet feeding apparatus described above.

Also, the image forming apparatus of the present invention can hence be realized with the image reading apparatus featuring the advantages of the sheet feeding apparatus described above.

Further, the image forming apparatus of the present invention can hence be realized featuring the advantages of the image reading apparatus equipped with the sheet feeding apparatus described above.

Further, according to the image forming apparatus of the present invention, the image memory 40 is arranged to use a minimum of its storage campsite storing the data of images when the number of the sheets stored in the document tray 22 is relatively small and thus allocate the remaining storage area for other processing. This allows the image reading operation of the image reading apparatus to be conducted in parallel with another processing such as the image forming process based on the image data received from a peripheral device, hence improving the efficiency of the overall operation.

In a conventional sheet feeding apparatus, for the purpose of detecting a relatively large number of the sheets in the sheet storing unit from a maximum to zero, a single contact provided for contacting with the leading end of a sheet is required to increase the length thereof. Also, when the contact is arranged to extend from upper side to lower side of the sheet storing unit, as the contact is rotatably moved for clearing each of the sheets being fed out, its movement requires a considerable capacity in the document storage. The length of the contact is hence limited because the movement in the space interrupts any roller or its axis of the feeding mechanism. Moreover, when the contact is arranged to extend from lower side to upper side in the sheet storing unit, it may hardly detect any upwardly curled sheet thus declining the accuracy of the detection.

The sheet feeding apparatus of the present invention has two contacts provided at both upper and lower sides of the sheet storing unit. This allows the length of the contacts to be shortened. Also, as any upwardly curled sheet is favorably be detected by one of the contacts, the detecting operation will be minimized in detection error.

The sheet feeding apparatus of the present invention has the detecting areas of the two, first and second, contacts arranged to partially overlap each other, thus creating no undetectable area where either of the contacts cannot reach. Also, since the overlap between the two detecting areas of the two contacts is sufficiently increased, the detecting operation can be stable regardless of any discrepancy in the characteristics of the two contacts.

The sheet feeding apparatus of the present invention is arranged in which a stack of the sheets is controllably kept so that the uppermost sheet is kept at the predetermined height when the number of the sheets in the sheet storing unit is increased. Accordingly, the sheets can be fed out one by one from the uppermost one, hence ensuring the stability of the feeding operation. Also, as the sheet storing unit is controlled to elevate and lower within the detecting areas of the two, first and second, contacts, the sheets can certainly be detected for their presence or absence regardless of the position of the sheet storing unit.

The sheet feeding apparatus of the present invention permits the volume of the sheets stored in the sheet storing unit to be roughly determined by combining the detection result of the first contact and the detection result of the second contact. More specifically, it is judged that the number of the sheets is small when the first contact detects the presence of the sheets and the second contact detects the absence of the sheets. It is judged that the number of the sheets is large when both the first and second contacts detect the presence of the sheets. It is hence judged that no sheet is stored when both the first and second contacts detect the absence of the sheets. Also, it is judged that the number of the sheets is small in the sheet storing unit positioned at upper when only the second contact detects the presence of the sheets. On the contrary, it is judged that the number of the sheets is small in the sheet storing unit positioned at lower when only the first contact detects the presence of the sheets.

The sheet feeding apparatus of the present invention is arranged in which the motor is controlled for driving the elevation/lowering mechanism of the sheet storing unit at a higher speed when it is judged that the number of the sheets is small in the sheet storing unit positioned at its lower-limit position where a maximum of the sheets can be stored. As a result, the sheet storing unit can quickly be elevated to the position where the sheets can be picked up from the sheet storing unit.

The image reading apparatus of the present invention can hence be provided featuring the advantages of the sheet feeding apparatus described above.

The image forming apparatus of the present invention can hence be provided featuring the advantages of the sheet feeding apparatus described above.

The image forming apparatus of the present invention can hence be provided featuring the advantages of the image reading apparatus described above.

The image forming apparatus of the present invention has the memory arranged to use a minimum of its storage capacity for storing the data of images when the number of the sheets stored in the sheet storing unit is relatively small and thus allocate the remaining storage area for other processing. This allows the image reading operation of the image reading apparatus to be conducted in parallel with another processing such as the image forming process based on the image data received from a peripheral device, hence improving the efficiency of the overall operation.

As the present invention may be embodied in several forms without departing from the spirit of essential characteristics thereof, those embodiments are therefore illustrative and not restrictive, since the scope of the present invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feeding apparatus comprising: a sheet storing unit in which a number of sheets are stored in a stack; a sheet feeding mechanism for picking up and feeding out the sheets stored in said sheet storing unit in a sequence from the uppermost one; and a sheet detector having a contact for contacting the sheets stored in said sheet storing unit to detect whether the sheets are stored or not in said sheet storing unit, wherein said contact consists of a first contact extending downwardly from a higher position than said sheet storing unit and a second contact extending upwardly from a lower position than said sheet storing unit, said sheet detector includes a first sheet detector arranged at a position higher than said sheet storing unit and a second sheet detector arranged at a position lower than said sheet storing unit, said first contact is provided in said first sheet detector while said second contact is provided in said second sheet detector, and said first and second contacts are configured so that a first detecting area of said first contact for detecting the sheets stored in said sheet storing unit, and a second detecting area of said second contact for detecting the sheets stored in said sheet storing unit partially overlap each other.

2. The sheet feeding apparatus as set forth in claim 1, further comprising:

a height detector for detecting the height of the uppermost one of the sheets stored in said sheet storing unit;

an elevation/lowering mechanism for elevating or lowering said sheet storing unit at a predetermined speed within a predetermined range; and a control circuit for controlling said elevation/lowering mechanism in response to a detection result of said height detector so as to keep the height of said sheet storing unit where the height of the uppermost one of the sheets stored in said sheet storing unit is equal to a height for picking up the sheets within said first and second detecting areas.

3. The sheet feeding apparatus as set forth in claim 2, further comprising:

a sheet volume calculating circuit for determining a volume of the sheets stored in said sheet storing unit based on a detection result of said first contact and a detection result of said second contact.

4. The sheet feeding apparatus as set forth in claim 3, further comprising:

a sheet storing unit position detector for detecting whether or not said sheet storing unit is at its lower-limit position within said predetermined range; and a control circuit for controlling said elevation/lowering mechanism to elevate said sheet storing unit at a speed higher than said predetermined speed when said sheet storing unit position detector detects that said sheet storing unit is at the lower-limit position and said sheet volume calculating circuit determines that the volume of the sheets stored in said sheet storing unit is the volume which is not detected within said first detecting area.

5. An image reading apparatus which has a sheet feeding apparatus comprising: a sheet storing unit in which a number of sheets are stored in a stack; a sheet feeding mechanism for picking up and feeding out the sheets stored in said sheet storing unit in a sequence from the uppermost one; and a sheet detector having a contact for contacting the sheets stored in said sheet storing unit to detect whether the sheets are stored or not in said sheet storing unit, wherein said contact consists of a first contact extending downwardly from a higher position than said sheet storing unit and a second contact extending upwardly from a lower position than said sheet storing unit, said sheet detector includes a first sheet detector arranged at a position higher than said sheet storing unit and a second sheet detector arranged at a position lower than said sheet storing unit, said first contact is provided in said first sheet detector while said second contact is provided in said second sheet detector, and said first and second contacts are configured so that a first detecting area of said first contact for detecting the sheets stored in said sheet storing unit, and a second detecting area of said second contact for detecting the sheets stored in said sheet storing unit partially overlap each other.

6. The image reading apparatus as set forth in claim 5, wherein said sheet feeding apparatus further comprising:

a height detector for detecting the height of the uppermost one of the sheets stored in said sheet storing unit;

an elevation/lowering mechanism for elevating or lowering said sheet storing unit at a predetermined speed within a predetermined range; and a control circuit for controlling said elevation/lowering mechanism in response to a detection result of said height detector so as to keep the height of said sheet storing unit where the height of the uppermost one of the sheets stored in said sheet storing unit is equal to a height for picking up the sheets within said first and second detecting areas.

7. The image reading apparatus as set forth in claim 6, wherein said sheet feeding apparatus further comprising:

a sheet volume calculating circuit for determining a volume of the sheets stored in said sheet storing unit based on a detection result of said first contact and a detection result of said second contact.

8. The image reading apparatus as set forth in claim 7, wherein said sheet feeding apparatus further comprising:

a sheet storing unit position detector for detecting whether or not said sheet storing unit is at its lower-limit position within said predetermined range; and a control circuit for controlling said elevation/lowering mechanism to elevate said sheet storing unit at a speed higher than said predetermined speed when said sheet storing unit position detector detects that said sheet storing unit is at the lower-limit position and said sheet volume calculating circuit determines that the volume of the sheets stored in said sheet storing unit is the volume which is not detected within said first detecting area.

9. An image forming apparatus which has a sheet feeding apparatus comprising: a sheet storing unit in which a number of sheets are stored in a stack; a sheet feeding mechanism for picking up and feeding out the sheets stored in said sheet storing unit in a sequence from the uppermost one; and a sheet detector having a contact for contacting the sheets stored in said sheet storing unit to detect whether the sheets are stored or not in said sheet storing unit, wherein said contact consists of a first contact extending downwardly from a higher position than said sheet storing unit and a second contact extending upwardly from a lower position than said sheet storing unit, said sheet detector includes a first sheet detector arranaed at a position higher than said sheet storing unit and a second sheet detector arranged at a position lower than said sheet storing unit, said first contact is provided in said first sheet detector while said second contact is provided in said second sheet detector, and said first and second contacts are configured so that a first detecting area of said first contact for detecting the sheets stored in said sheet storing unit, and a second detecting area of said second contact for detecting the sheets stored in said sheet storing unit partially overlap each other.

10. The image forming apparatus as set forth in claim 9, wherein said sheet feeding apparatus further comprising:

a height detector for detecting the height of the uppermost one of the sheets stored in said sheet storing unit;

an elevation/lowering mechanism for elevating or lowering said sheet storing unit at a predetermined speed within a predetermined range; and a control circuit for controlling said elevation/lowering mechanism in response to a detection result of said height detector so as to keep the height of said sheet storing unit where the height of the uppermost one of the sheets stored in said sheet storing unit is equal to a height for picking up the sheets within said first and second detecting areas.

11. The image forming apparatus as set forth in claim 10, wherein said sheet feeding apparatus further comprising:

a sheet volume calculating circuit for determining a volume of the sheets stored in said sheet storing unit based on a detection result of said first contact and a detection result of said second contact.

12. The image forming apparatus as set forth in claim 11, wherein said sheet feeding apparatus further comprising:

a sheet storing unit position detector for detecting whether or not said sheet storing unit is at its lower-limit position within said predetermined range; and a control circuit for controlling said elevation/lowering mechanism to elevate said sheet storing unit at a speed higher than said predetermined speed when said sheet storing unit position detector detects that said sheet storing unit is at the lower-limit position and said sheet volume calculating circuit determines that the volume of the sheets stored in said sheet storing unit is the volume which is not detected within said first detecting area.

13. An image forming apparatus comprising: an image reading apparatus in which a sheet feeding apparatus is incorporated, said sheet feeding apparatus comprising: a sheet storing unit in which a number of sheets are stored in a stack; a sheet feeding mechanism for picking up and feeding out the sheets stored in said sheet storing unit in a sequence from the uppermost one; and a sheet detector having a contact for contacting the sheets stored in said sheet storing unit to detect whether the sheets are stored or not in said sheet storing unit, wherein said contact consists of a first contact extending downwardly from a higher position than said sheet storing unit and a second contact extending upwardly from a lower position than said sheet storing unit, said sheet detector includes a first sheet detector arranged at a position higher than said sheet storing unit and a second sheet detector arranged at a position lower than said sheet storing unit, said first contact is provided in said first sheet detector while said second contact is provided in said second sheet detector, and said first and second contacts are configured so that a first detecting area of said first contact for detecting the sheets stored in said sheet storing unit, and a second detecting area of said second contact for detecting the sheets stored in said sheet storing unit partially overlap each other.

14. The image forming apparatus as set forth in claim 13, wherein said sheet feeding apparatus further comprising:

a height detector for detecting the height of the uppermost one of the sheets stored in said sheet storing unit;

an elevation/lowering mechanism for elevating or lowering said sheet storing unit at a predetermined speed within a predetermined range; and a control circuit for controlling said elevation/lowering mechanism in response to a detection result of said height detector so as to keep the height of said sheet storing unit where the height of the uppermost one of the sheets stored in said sheet storing unit is equal to a height for picking up the sheets within said first and second detecting areas.

15. The image forming apparatus as set forth in claim 14, wherein said sheet feeding apparatus further comprising:

a sheet volume calculating circuit for determining a volume of the sheets stored in said sheet storing unit based on a detection result of said first contact and a detection result of said second contact.

16. The image forming apparatus as set forth in claim 15, wherein said sheet feeding apparatus further comprising:

a sheet storing unit position detector for detecting whether or not said sheet storing unit is at its lower-limit position within said predetermined range; and a control circuit for controlling said elevation/lowering mechanism to elevate said sheet storing unit at a speed higher than said predetermined speed when said sheet storing unit position detector detects that said sheet storing unit is at the lower-limit position and said sheet volume calculating circuit determines that the volume of the sheets stored in said sheet storing unit is the volume which is not detected within said first detecting area.

17. An image forming apparatus comprising:

an image reading apparatus in which a sheet feeding apparatus is incorporated, said sheet feeding apparatus comprising: a sheet storing unit in which a number of sheets are stored in a stack; a sheet feeding mechanism for picking up and feeding out the sheets stored in said sheet storing unit in a sequence from the uppermost one; and a sheet detector having a contact for contacting the sheets stored in said sheet storing unit to detect the presence or absence of the sheets; wherein said contact consists of a first contact extending downwardly from a higher position than said sheet storing unit and a second contact extending upwardly from a lower position than said sheet storing unit; said sheet detector includes a first sheet detector arranged at a position higher than said sheet storing unit and a second sheet detector arranged at a position lower than said sheet storing unit, and said first contact is provided in said first sheet detector while said second contact is provided in said second sheet detector; and said first and second contacts are configured so that a first detecting area of said first contact for detecting the sheets stored in said sheet storing unit and a second detecting area of said second contact for detecting the sheets stored in said sheet storing unit partially overlap each other;

a height detector for detecting the height of the uppermost one of the sheets stored in said sheet storing unit;

an elevation/lowering mechanism for elevating or lowering said sheet storing unit at a predetermined speed within a predetermined range;

a control circuit for controlling said elevation/lowering mechanism in response to a detection result of said height detector so as to keep the height of said sheet storing unit where the height of the uppermost one of the sheets stored in said sheet storing unit is equal to a height for picking up the sheets within said first and second detecting areas;

a sheet volume calculating circuit for determining a volume of the sheets stored in said sheet storing unit based on a detection result of said first contact and a detection result of said second contact;

a memory unit for storing the data of images read by said image reading apparatus and inputted from the external;

an image forming unit for forming images based on the data stored in said memory unit; and a control circuit for setting an allocated capacity of said memory unit for storing the data of images read by said image reading apparatus in response to the volume of the sheets stored in said sheet storing unit calculated by said sheet volume calculating circuit, and for permitting the input of images from the external when the allocated capacity of said memory unit for storing the data of images read by said image reading apparatus is not larger than a predetermined value.

* * * * *